US011077378B2

(12) United States Patent
Hunter et al.

(10) Patent No.: US 11,077,378 B2
(45) Date of Patent: Aug. 3, 2021

(54) AMUSEMENT RIDE VEHICLE AND VEHICLE CONTROL SYSTEM

(71) Applicant: PROSLIDE TECHNOLOGY INC., Ottawa (CA)

(72) Inventors: Richard D. Hunter, Ottawa (CA); Raymond T. Smegal, Ottawa (CA)

(73) Assignee: ProSlide Technology Inc., Ottawa (CA)

( * ) Notice: Subject to any disclaimer, the term of this patent is extended or adjusted under 35 U.S.C. 154(b) by 0 days.

(21) Appl. No.: 16/507,263

(22) Filed: Jul. 10, 2019

(65) Prior Publication Data

US 2019/0329141 A1 Oct. 31, 2019

Related U.S. Application Data

(63) Continuation of application No. 14/436,726, filed as application No. PCT/CA2013/050794 on Oct. 21, 2013, now Pat. No. 10,384,138.

(60) Provisional application No. 61/716,200, filed on Oct. 19, 2012.

(51) Int. Cl.

| | |
|---|---|
| ***A63G 21/18*** | (2006.01) |
| ***A63G 7/00*** | (2006.01) |
| ***A63G 3/02*** | (2006.01) |

(52) U.S. Cl.

CPC ..... *A63G 21/18* (2013.01); *A63G 3/02* (2013.01); *A63G 7/00* (2013.01)

(58) Field of Classification Search

CPC ..... A63G 3/00; A63G 21/00; A63G 21/18; A63G 31/007; B63B 1/00; B63B 1/042; B63B 8/32

USPC ..... 472/13, 117, 128–129; 112/56, 62, 67; 114/56, 62, 67

See application file for complete search history.

(56) References Cited

U.S. PATENT DOCUMENTS

| | | | |
|---|---|---|---|
| 2,604,055 | A | 7/1949 | Snowden |
| 3,000,022 | A | 9/1961 | Cathey et al. |
| 3,438,074 | A | 4/1969 | Goyen |
| 5,031,556 | A | 7/1991 | Blee |
| 5,213,547 | A | 5/1993 | Lochtefeld |
| 5,219,315 | A | 6/1993 | Fuller et al. |
| 5,230,662 | A | 7/1993 | Langford |

(Continued)

FOREIGN PATENT DOCUMENTS

| | | | |
|---|---|---|---|
| CA | 2654714 | A1 | 3/2002 |
| CA | 2674329 | A1 | 1/2011 |

(Continued)

OTHER PUBLICATIONS

International Search Report, dated Jan. 2, 2014, from the Canadian Intellectual Property Office in corresponding International Application No. PCT/CA2013/050794, 2 pages.

(Continued)

*Primary Examiner* — Kien T Nguyen

(74) *Attorney, Agent, or Firm* — Finnegan, Henderson, Farabow, Garrett & Dunner, L.L.P.

(57) ABSTRACT

An amusement ride vehicle has a body and at least one of recesses and protrusions on a perimeter surface of body. The at least one of recesses and protrusions defining fluid impact surfaces. The fluid impact surfaces being at an angle to an intended direction of motion of the vehicle. The fluid impact surfaces are adapted to affect motion of the vehicle when the fluid impact surfaces are impacted by a fluid.

19 Claims, 19 Drawing Sheets

(56) References Cited

U.S. PATENT DOCUMENTS

| | | | | |
|---|---|---|---|---|
| 5,503,597 | A | 4/1996 | Lochtefeld et al. | |
| 5,527,646 | A | 6/1996 | Ogino et al. | |
| 5,716,282 | A | 2/1998 | Ring et al. | |
| 5,738,590 | A | 4/1998 | Lochtefeld et al. | |
| 6,006,672 | A | 12/1999 | Newfarmer et al. | |
| 6,435,927 | B1 | 8/2002 | Fireman | |
| 6,527,646 | B1 | 3/2003 | Briggs | |
| 6,561,914 | B2 | 5/2003 | Henry | |
| 6,702,687 | B1 | 3/2004 | Henry | |
| 6,743,108 | B2 | 6/2004 | Hunter | |
| 6,758,231 | B1 | 7/2004 | Lochtefeld et al. | |
| 7,229,359 | B2 | 6/2007 | Henry | |
| 7,285,053 | B2 | 10/2007 | Henry et al. | |
| 7,497,784 | B2 | 3/2009 | Henry | |
| 7,727,077 | B2 | 6/2010 | Henry et al. | |
| 7,731,595 | B2 | 6/2010 | Hlynka | |
| 7,740,542 | B2 | 6/2010 | Henry et al. | |
| 7,758,435 | B2 | 7/2010 | Henry et al. | |
| 7,758,535 | B2 | 7/2010 | Levine et al. | |
| 7,762,900 | B2 | 7/2010 | Henry et al. | |
| 7,766,753 | B2 | 8/2010 | Henry et al. | |
| 7,785,207 | B2 | 8/2010 | Henry et al. | |
| 7,896,752 | B2 | 3/2011 | Yule | |
| 7,942,752 | B2 | 5/2011 | Henry | |
| 8,070,616 | B2 | 12/2011 | Dubois et al. | |
| 8,075,413 | B2 | 12/2011 | Henry et al. | |
| 8,079,916 | B2 | 12/2011 | Henry | |
| 8,197,353 | B2 | 6/2012 | Brassard | |
| 8,210,954 | B2 | 7/2012 | Henry et al. | |
| 8,282,497 | B2 | 10/2012 | Henry et al. | |
| 8,453,579 | B2 | 6/2013 | Nemeth | |
| 8,579,715 | B2 | 11/2013 | Olive et al. | |
| 9,220,989 | B2 | 12/2015 | Fisher | |
| D870,015 | S * | 12/2019 | Hunter | D12/317 |
| 2002/0082097 | A1 | 6/2002 | Henry | |
| 2003/0069078 | A1 | 4/2003 | Aragona et al. | |
| 2005/0034768 | A1 | 2/2005 | Lochtefeld et al. | |
| 2007/0060403 | A1 | 3/2007 | Henry | |
| 2010/0160054 | A1 | 6/2010 | Henry | |
| 2011/0028227 | A1 | 2/2011 | Dubois et al. | |
| 2012/0201605 | A1 | 9/2012 | Hill | |
| 2012/0258812 | A1 | 10/2012 | Osterman et al. | |
| 2013/0184087 | A1 | 7/2013 | Degirmenci | |
| 2014/0171211 | A1 | 6/2014 | Fisher | |
| 2016/0136527 | A1 | 5/2016 | Hunter | |
| 2017/0043264 | A1 | 2/2017 | Hunter et al. | |

FOREIGN PATENT DOCUMENTS

| | | | |
|---|---|---|---|
| CA | 2888630 | A1 | 4/2014 |
| CN | 2 905 159 | Y | 5/2007 |
| CN | 101 417 179 | A | 4/2009 |
| CN | 104797312 | A | 7/2015 |
| EP | 0601641 | A1 | 6/1994 |
| JP | H03258280 | | 11/1991 |
| JP | 10-216363 | | 8/1998 |
| WO | WO 88/05745 | A1 | 8/1988 |
| WO | WO 9204087 | A1 | 3/1992 |
| WO | WO 2007/027841 | A2 | 3/2007 |
| WO | WO 2012/048016 | A2 | 4/2012 |
| WO | WO 2013/000090 | A1 | 1/2013 |
| WO | WO 2014/059551 | A1 | 4/2014 |
| WO | WO 2015/161382 | A1 | 10/2015 |

OTHER PUBLICATIONS

Officed Action, issued in corresponding Chinese Applicatio No. 201380060304.0, from the Chinese Patent Office, dated Jun. 29, 2016.

Communication of an extended European Search Report, pursuant to Rule 62 EPC, from the European Patent Office, issued in corresponding Application No. 16192350.3-1658, dated Mar. 28, 2017, 8 pages.

Communication pursuant to Rule 62 EPC, from the European Patent Office, issued in Application No. 15783231.2-1658, regarding an extended European Search Report, dated Nov. 3, 2017, 12 pages.

Communication pursuant to Rules 70(2) and 70a(2) EPC, from the European Patent Office, issue in Application No. 15783231.1-1658, dated Nov. 21, 2017, 1 page.

Search Report and Written Opinion, issued from the Intellectual Property Office of Singapore, in corresponding Patent Application No. 11201608816S, dated Nov. 28, 2017, 10 pages.

Office Action, issued in corresponding Chinese Application No. 201380060304.0, from the Chinese Patent Office, dated Feb. 23, 2018.

Office Action, issued in corresponding Chinese Application No. 201380060304.0, from the Chinese Patent Office, dated May 15, 2017.

Third Party Observation, issued in corresponding International Application No. PCT/CA2016/050838, dated Feb. 6, 2018.

Final Office Action, issued in U.S. Appl. No. 15/605,859, dated Jun. 8, 2018.

First Office Action Examination Report, issued by the Chinese Patent Office, in corresponding Application No. 2016/80088550.0 (27 pages).

Supplementary European Search Report, issued by the European Patent Office, in corresponding Application No. EP 16 90 8371, dated Jan. 13, 2020 (6 pages).

JP 75956-577, Notice of Reasons for Rejections, issued by the Japanese Patent Office, in corresponding Application No. 2019-501632 (4 pages).

RU Office Notification, issued in Application No. 2019/104086/12(007659), dated Aug. 27, 2019 (7 pages).

RU Search Report, issued in Application No. 2019/104086/12(007659), dated Aug. 16, 2019 (4 pages).

SG Written Opinion, issued by the Intellectual Property Office of Singapore, in corresponding Application No. 11201900151T, (8 pages).

International Search Report, issued by the Canadian Intellectual Property Office, International Application No. PCT/CA2016/050838, dated Mar. 17, 2017, 12 pages.

Communication pursuant to Rule 69 EPC, from the European Patent Office, issued in corresponding Application No. 16192350.3-1658, dated May 3, 2017, 2 pages.

Office Action, dated Jul. 28, 2017, issued in U.S. Appl. No. 15/305,859 (7 pages).

Final Office Action, issued in U.S. Appl. No. 15/305,859, dated Jun. 8, 2018.

Office Action, issued from the Korean Intellectual Property Office, in corresponding Korean Application No. 10-2015-7013127, 15 pages.

* cited by examiner

AMUSEMENT RIDE VEHICLE AND VEHICLE CONTROL SYSTEM

FIELD OF THE INVENTION

The invention relates generally to amusement rides, and in particular to rides in which participants ride in or on vehicles.

BACKGROUND OF THE INVENTION

In the past few decades, water-based amusement rides have become increasingly popular. Such rides can provide similar thrills to roller-coaster rides, with the additional features of the cooling effect of water and the excitement of being splashed.

The most common water-based amusement rides are flume-style waterslides in which a participant slides along a channel or "flume", either on his or her body, or on or in a vehicle. Water is provided in the flume to provide lubrication between the body/vehicle and the flume surface, and to provide the above-mentioned cooling and splashing effects. Typically, the motion of the participant in the flume is controlled predominantly by the contours of the flume (hills, valleys, turns, drops, etc.) in combination with gravity.

As thrill expectations of participants have increased, demand for greater control of participants' movement in the flume has correspondingly increased. Thus various techniques have been applied to accelerate or decelerate participants by means other than gravity. For example, a participant may be accelerated or decelerated using powerful water jets. Other rides use a conveyor belt to convey a participant to the top of a hill the participant would not otherwise crest on the basis of his or her momentum alone.

However, such existing means of controlling the movement of a participant raise safety and comfort concerns even when he or she is riding in a vehicle. For example, a water jet powerful enough to affect the motion of a waterslide vehicle could injure the participant if he or she is hit in the face or back of the head by the jet, as might be the case if the participant falls out of the vehicle. Similarly, a participant extending a limb out of a vehicle could be injured by a fast-moving conveyor belt. If the weight distribution is not correct, the vehicle could be overturned by the force of the jet.

SUMMARY OF THE INVENTION

An aspect of the invention relates to an amusement ride vehicle comprising: a body and at least one of recesses and protrusions on a perimeter surface of body, the at least one of recesses and protrusions defining fluid impact surfaces, the fluid impact surfaces being at an angle to an intended direction of motion of the vehicle, the fluid impact surfaces being adapted to affect motion of the vehicle when the fluid impact surfaces are impacted by a fluid.

Another aspect of the invention relates to an amusement ride vehicle motion control system comprising an amusement ride vehicle as described above; a channel; and at least one fluid spray source positioned to spray fluid over the channel at the fluid impact surfaces.

A further aspect of the invention relates to an amusement ride vehicle motion control system comprising: a channel; a plurality of fluid spray sources positioned to spray fluid over the channel; an amusement ride vehicle comprising: a body and at least one of recesses and protrusions on a perimeter surface of body, the at least one of recesses and protrusions defining fluid impact surfaces, the fluid impact surfaces being at an angle to an intended direction of motion of the vehicle, the fluid impact surfaces being adapted to affect motion of the vehicle when the fluid impact surfaces are impacted by a flow of fluid from the plurality of fluid spray sources.

A still further aspect of the invention relates to an amusement ride vehicle motion control system comprising: a channel; a plurality of fluid spray sources positioned to spray fluid over the channel; at least one first sensor adapted detect when the amusement ride vehicle enters a zone of the channel; at least one valve associated with the plurality of fluid spray sources; and a controller adapted to open the valve to turn on the fluid spray source in response to an amusement ride vehicle entering the zone.

In some embodiments, at least a portion of an underside of the body is adapted to slide on a sliding surface.

In some embodiments, the vehicle is adapted to float in a fluid.

In some embodiments, the fluid is water.

In some embodiments, the at least one of recesses and protrusions comprise a plurality of recesses or a plurality of protrusions spaced along opposite sides of the vehicle body.

In some embodiments, the vehicle comprises outer sidewalls and a bottom surface and the plurality of recesses or the plurality of protrusions do not extend outward past the outer sidewalls or beneath the bottom surface of the vehicle body.

In some embodiments, the vehicle comprises sides and a bottom and the plurality of recesses or the plurality of protrusions are located beneath the sides and adjacent the bottom of the body.

In some embodiments, the vehicle body has a forward end and a rearward end, and the at least one of recesses and protrusions have an inward end and an outward end, and the inward end of the at least one of recesses and protrusions is closer to the rear end than to the front end such that the at least one of recesses and protrusions are angled forward.

In some embodiments, the fluid impact surfaces face the rear end on the vehicle body and are concave.

In some embodiments, the at least one of recesses and protrusions are removable and repositionable.

In some embodiments, the vehicle further comprises at least one channel, and the at least one of recesses and protrusions are connected to the at least one channel for directing water away from the fluid impact surface after impact.

In some embodiments, the at least one channel comprises a plurality of channels and each of the at least one of recesses and protrusions are connected to respective channels of the plurality of channels.

In some embodiments, at least some of the plurality of channels are interconnected.

In some embodiments, the at least one channel directs fluid behind, below or through the vehicle.

In some embodiments, the amusement ride vehicle motion control system further comprises a first sensor adapted detect when the amusement ride vehicle enters a zone of the sliding surface; at least one valve associated with the plurality of fluid spray sources; and a controller adapted to open the valve to turn on the fluid spray source in response to the amusement ride vehicle entering the zone.

In some embodiments, the amusement ride vehicle motion control system further comprises a second sensor adapted to detect when the amusement ride vehicle leaves a zone of the channel, the controller being adapted to close the valve to turn off the water spray source in response to the amusement ride vehicle exiting the zone.

In some embodiments, the controller is a programmable logic controller.

In some embodiments, the amusement ride vehicle motion control system further comprises a pump connected to the programmable logic controller by a variable frequency drive, wherein the variable frequency drive is adapted to maintain the pump in a standby mode when the valve is closed, and wherein the variable frequency drive is adapted to actuate the pump when the valve is open.

In some embodiments, the channel comprises a sliding surface and the vehicle is adapted to slide on the sliding surface.

In some embodiments, the channel is adapted to hold sufficient fluid to float the vehicle and the vehicle is adapted to float in the channel.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the invention will now be described with reference to the attached drawings in which.

DETAILED DESCRIPTION OF THE EMBODIMENTS OF THE INVENTION

An amusement ride vehicle motion control system includes a channel. The channel may include sides and a bottom surface along which a vehicle may slide or over which the vehicle may float, roll or otherwise move. The channel may include a plurality of fluid spray sources positioned to spray fluid over the channel. The fluid spray sources may be positioned to spray fluid, such as jet of water, at an angle at least partially in an intended direction of travel of the vehicle.

The system may include an amusement ride vehicle. The vehicle may comprise a body and at least one of recesses and protrusions on a perimeter surface of the body. The at least one of recesses and protrusions define fluid impact surfaces. The fluid impact surfaces are at an angle to an intended direction of motion of the vehicle; the fluid impact surfaces are positioned and angled to receive the impact of fluid sprayed from the fluid spray sources. The recesses and/or protrusions are adapted and positioned to affect motion of the vehicle when the fluid impact surfaces are impacted by a flow of fluid from the plurality of fluid spray sources.

The control system may include a first sensor adapted to detect when the amusement ride vehicle enters a zone of the channel. The control system may also include one or more valves associated with the plurality of fluid spray sources, a controller adapted to open the valves to turn on the fluid spray source in response to the amusement ride vehicle entering the zone, and a variable frequency drive to control the flow of water to the valves.

Figure 1:
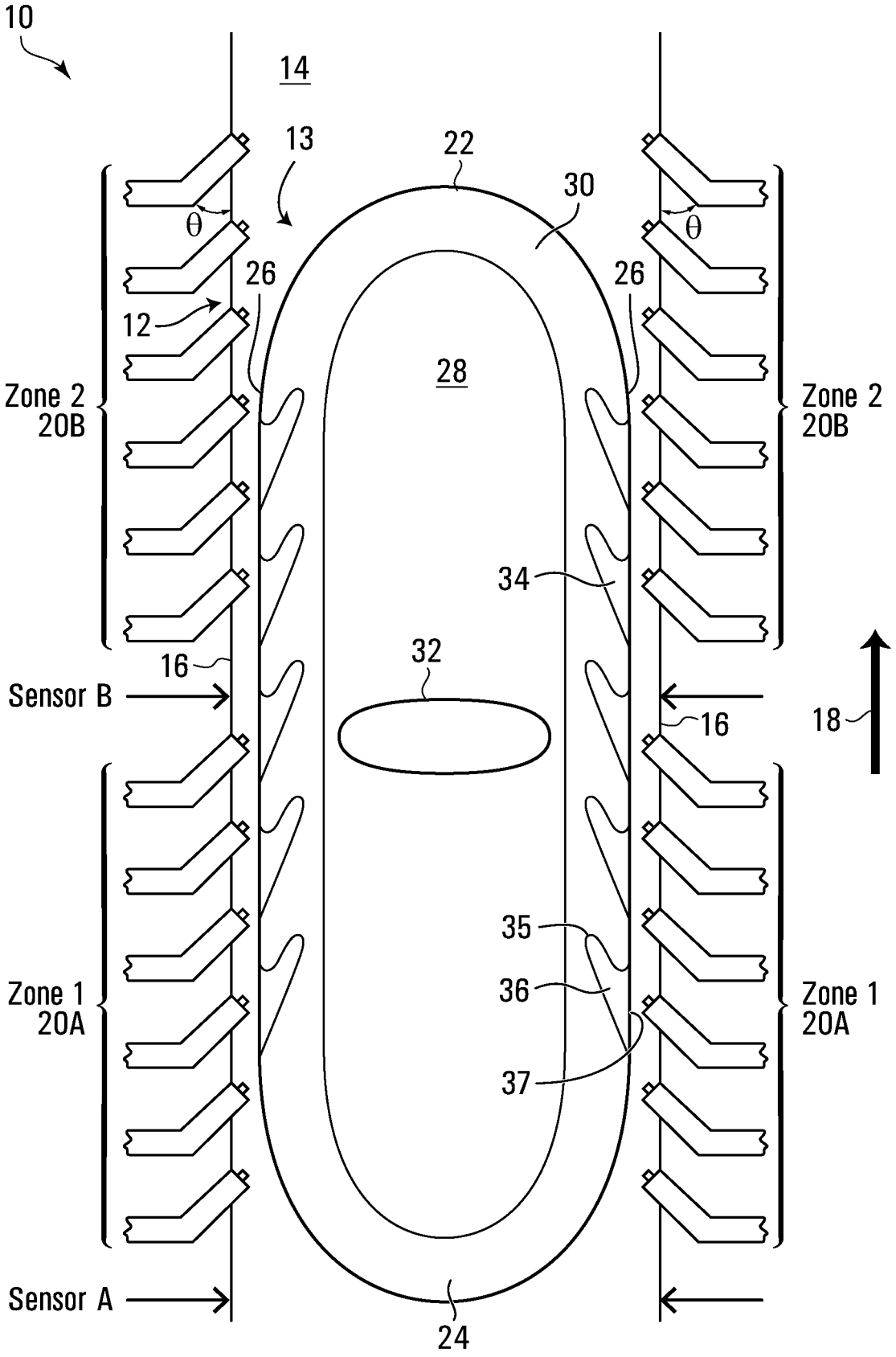
FIG. 1 is a schematic top view of an amusement ride vehicle control system according to an embodiment of the invention.

FIG. 1 shows a first embodiment of an amusement ride motion control system 10. The system 10 includes a channel 12 and a vehicle 13. Only a portion of the channel 12 is depicted in FIG. 1. The channel 12 may comprise a flume style slide having a central sliding surface 14 between side walls 16. The sliding surface may be lubricated with water, as in a traditional flume ride, or may have a low friction coating. The channel 12 may alternatively be a water filled channel in which there is sufficient fluid that the vehicle 13 may float or the vehicle may include wheels and may roll or otherwise move. The wall 16 may be closely adjacent the path of the vehicle 13 on sliding surface 14 to assist in guiding the vehicle along a predetermined path, or spaced further away from an indeterminate path of the vehicle 13.

In this embodiment, the channel 12 shows two zones, namely Zone 1 and Zone 2. A direction of travel of the vehicle 13 along the channel 12 is from Zone 1 to Zone 2 as indicated by the arrow 18. At the entrance to Zone 1, one or more sensors A may be positioned. The sensors A may be any type of sensor which can detect the entrance of the vehicle 13 into Zone 1. Similarly, at the entrance of Zone 2 from Zone 1, one or more sensors B may be positioned. The sensors B may also be any type of sensor which can detect the entrance of the vehicle 13 into Zone 1. The sensors may also be omitted or may be present only at Zone 1 or Zone 2 but not at both.

Spaced along the walls 16 are water jet or spray sources 20A and 20B. The first spray sources 20A are located in Zone 1 and the second spray sources 20B are located in Zone 2. In this embodiment, four spray sources 20A, 20B are depicted in each of Zones 1 and 2 which are laterally aligned with each other in pairs along the walls 16. In other embodiments, more or fewer spray sources 20A and 20B may be provided. In this embodiment, the fluid sprayed from the spray sources is water. In other embodiments, a different fluid may be sprayed, such as air or other gas. In some embodiments the spray source sprays horizontally; in other embodiments, the spray sources may spray at an upward or downward angle. In some embodiments the spray sources 20A and 20B may be narrowly focused to provide a jet of fluid; in other embodiments, the spray may be less focused.

In the present embodiment, the spray sources 20A, 20B are angled to direct water at an angle θ towards the direction of travel of the vehicle 13. In this embodiment, the angle θ of the spray sources 20A, 20B indicates the angle at which the water will be sprayed from the spray sources 20A, 20B into the channel 12. The angle θ in this embodiment is approximately 10° to 15° from the wall 16. In other embodiments the spray sources 20A, 20B may be directed at other angles to the direction of travel.

The spray sources may alternatively be perpendicular to the direction of travel, for example, to spin a round vehicle, or angled in a reverse direction, for example, to slow the velocity of the vehicle 13.

The spray sources 20A, 20B may include a spray nozzle and a source of fluid which is pressurized or pumped out through the spray nozzle. In this embodiment, the pressure of the spray may be about 50 PSI and the volume of the spray may be about 25 GPM. However, the exact pressure, volume and spray or jet pattern, whether narrowly focused or expansive, will be determined based on the requirements of the particular system. Additionally, the spray sources 20A, 20B may vary from each other and may be controllable with regards to pressure, volume, spray pattern and direction.

The vehicle 13 of this embodiment is a raft type vehicle with a front end 22, a rear end 24, sides 26, and a bottom 28. As seen from the top in the schematic view of FIG. 1, the vehicle 13 has a roughly elongated oval shaped body. An inflated tube 30 extends around the perimeter of the body of vehicle 13 and defines the front end 22, rear end 24 and sides 26. The bottom 28 connects to the bottom surface (not shown) of the inflated tube 30 to define an interior on the vehicle 13 for carrying passengers. In this embodiment, the vehicle 13 also includes a center partition 32. The vehicle 13 may accommodate two riders, one in front of and one behind the partition. It will be understood that the vehicle 13 is merely exemplary and other embodiments of the invention include numerous vehicle styles, as discussed further in respect to FIGS. 5A to 7C, and 10A to 10E.

In this embodiment, as noted above, the sides 26 are defined by the inflated tube 30. The inflated tube 30 may have a circular cross section such that the outer side walls of the vehicle 13 are curved. A series of recesses or intakes 34 are defined into the sides 26. In this embodiment, five mirror image pairs of recesses are spaced substantially equally along the sides 26 of the vehicle 13. The recesses 34 are angled in the direction of travel of the vehicle 13. The angle of the recesses 34 is substantially the same as the angle of the spray sources 20A, 20B such that, when spray from the spray sources 20A, 20B aligned with one of the recesses 34, the fluid sprays directly into the respective recess and impacts against the interior or impact surface 36.

Each of the recesses 34 is concave and has an inward end 35 and an outward end 37. As can be seen from FIG. 1, inward ends 35 of the recesses 34 are closer to the rear end 24 than to the front end 22 such that the recesses 34 are angled forward. With this configuration, the fluid impact surfaces 36 face the rear end 24 on the vehicle body and are concave.

In some embodiments, the shape of the recesses 34 and the angle θ of the spray sources 20A, 20B, is based on the Pelton Wheel turbine design.

It will be appreciated that the force of the fluid against the impact surfaces will affect the motion of the vehicle. The force imparted by the fluid impacting against the impact surfaces within the sides 26 of the vehicle 16 may be more effective in propelling the vehicle 13 in the intended direction of travel than water impacting against the side of a comparable vehicle without such recesses resulting in a more efficient energy transfer for the water to the vehicle motion. This may result in a significant decrease in power and water consumption and in noise. The system may also be able to propel heavier vehicles based on the increased efficiency.

Figure 2:
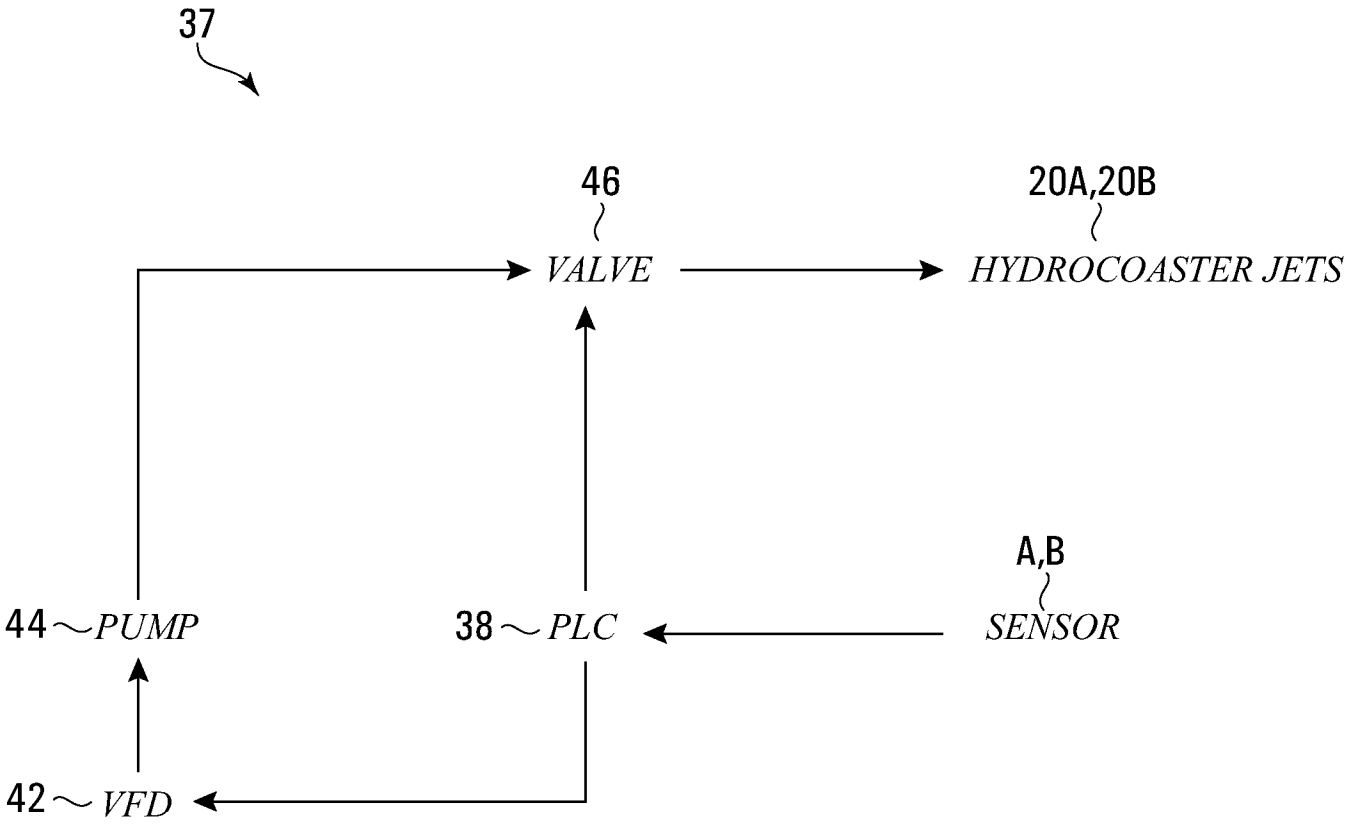
FIG. 2 is a schematic view of a control system for the amusement ride vehicle control system of FIG. 1.

FIG. 2 is a schematic view of an exemplary control system 37 for the amusement ride motion control system 10 of FIG. 1. In this control system, the sensors A, B provide input to a programmable logic controller (PLC) 38. The PLC 38 is connected to one or more valves 40 for controlling the flow of water to the spray sources 20A, 20B. The PLC 38 is also connected to a variable frequency drive (VFD) 42. The VFD 42 is in turn connected to a pump 44 for controlling the flow of water to the valves 40 and ultimately to the spray sources 20A, 20B.

It will be appreciated that control system 37 may be modified to eliminate some of these components. For example, the VFD 42 may be eliminated and an alternative means of driving the pump may be supplied. The programmable logic controller (PLC) 38 may be eliminated and an alternative control means used. In addition, the control system 37 and the sensors 20A, 20B may be completely eliminated and the spray sources 20A, 20B may be directly connected to the pump 44 or other source or fluid which flows constantly to provide a constant spray from the spray sources 20A, 20B.

Figure 3:
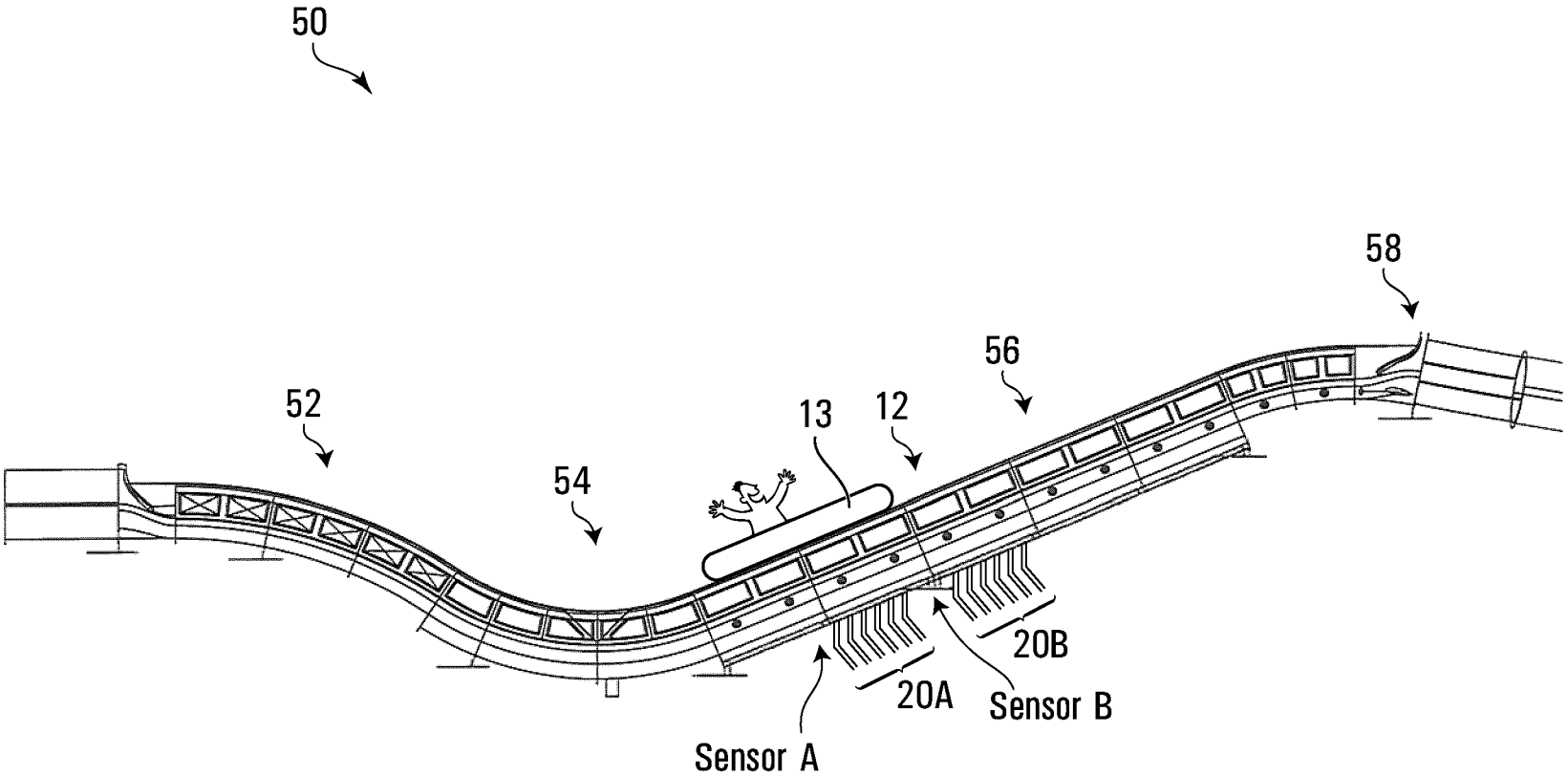
FIG. 3 is a schematic side view of a section of an amusement ride which incorporates the amusement ride vehicle control system of FIG. 1.

FIG. 3 shows a schematic side view of a zone or section 50 of an amusement ride which incorporates the control system according to the embodiment of FIGS. 1 and 2. In this embodiment, the section 50 includes an initial downward portion 52, a transitional concave or valley portion 54 and a subsequent upward portion 56 and a final slightly declined portion 58. The described portions and curvatures are exemplary only. Numerous other arrangements of upward, downward horizontal and transitional sections at various angles are also possible.

The vehicle 13 and the channel 12 are shown in FIG. 3 on the upward portion 56. The channel 12 is depicted without the sidewalls 16. The positioning of the sensors A, B and the spray sources 20A, 20B are also shown schematically. It will be appreciated, that a vehicle initially travelling down the downward portion 52 may not have enough momentum to travel up the upward portion 56 without the application of an external force. The operation of the control system 37 to provide the external force will be described with reference to FIGS. 1 to 4C.

Figures 4A, 4B, 4C:
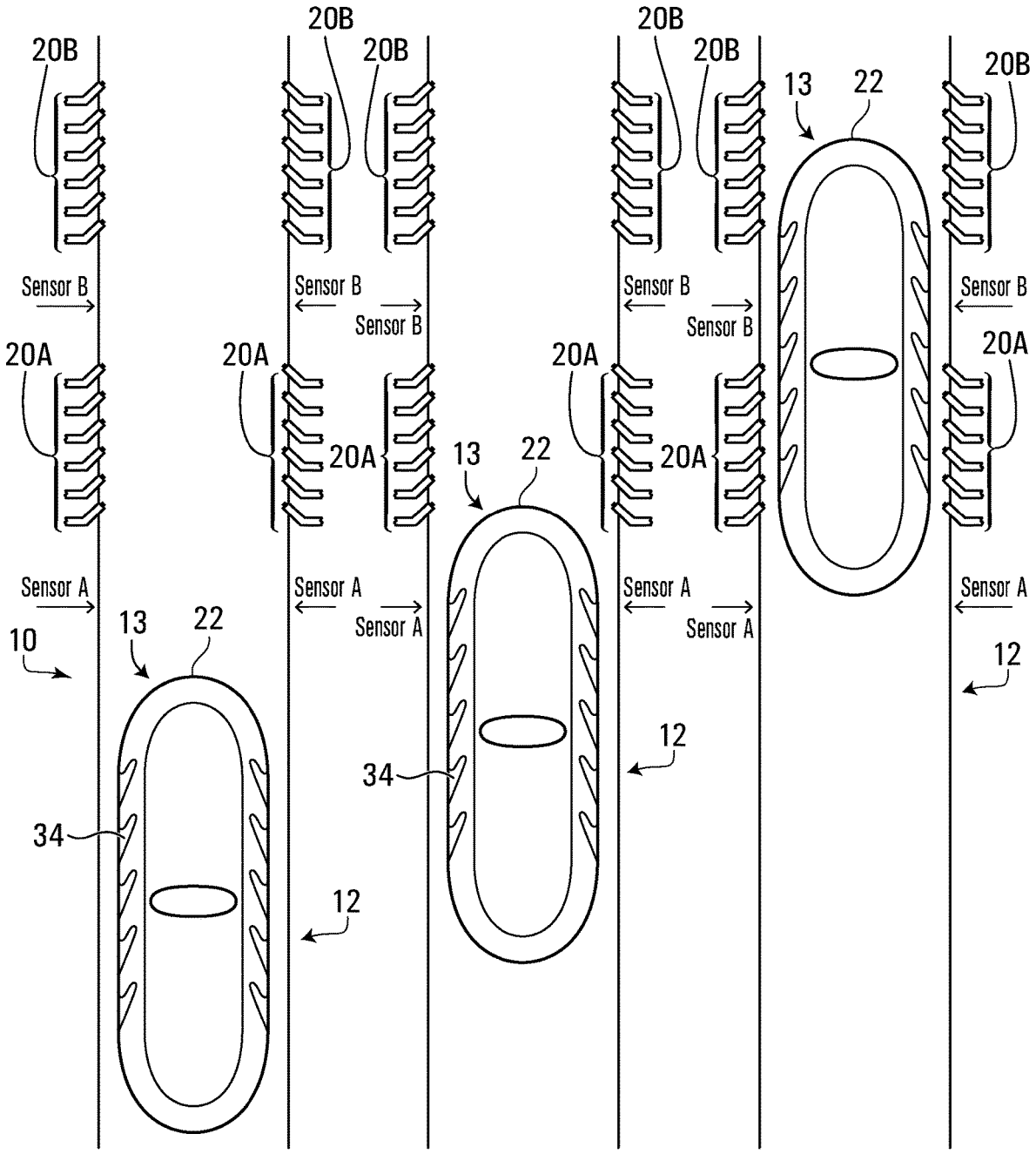
FIGS. 4A, 4B and 4C are schematic top views of the amusement ride vehicle control system of FIG. 1 with the vehicle shown in three different positions.

FIGS. 4A to 4C show the vehicle 13 in three different locations as it travels along the channel 12. In the first position, shown in FIG. 4A, which is equivalent, for example, to the valley portion 54 in FIG. 3, the vehicle 13 has not yet reached the sensor A. The control system 37 has not detected the vehicle 13 and the spray sources 20A, 20B are not spraying fluid.

In FIG. 4B, the front end 22 of the vehicle 13 is just passing the sensors A. When this happens, the sensors A detect the presence of the vehicle 13. The information is transmitted to the PLC 38. The PLC 38 in turn activates the VFD 42 to power the pump 44 to spray fluid such as water or air from the sources 20A. At the same time, the PLC 38 opens the valves 40 associated with the spray sources 20A so that the fluid pumped by the pump 44 sprayed out through the spray sources 20A. The fluid sprayed out through the spray sources 20A, which may be jets of water, impacts in the recesses 34 as described with reference to FIG. 1. The force imparted by the fluid from the spray source 20A provides momentum to push the vehicle 13 up the upward section 56, as shown in FIG. 3. In the position of FIG. 4B, the vehicle 13 has not yet reached the sensors B and thus the spray sources 20B are not spraying fluid.

In FIG. 4C, the front end 22 of the vehicle 13 has passed the sensors B. When this happens, the sensors B detect the presence of the vehicle 13. The information is transmitted to the PLC 38. Since the PLC 38 has already activated the VFD 42 to power the pump 44 to spray fluid from the sources 20A, in some embodiments it may be unnecessary for the PLC 38 to communicate with the VFD 42. In other embodiments, it may be necessary for the PLC 38 to communicate with the VFD 42 to increase the fluid pressure for pumping from the additional spray sources 20B. In either case, the PLC 38 opens the valves 40 associated with the spray sources 20B so that the fluid pumped by the pump 44 sprayed out through the spray sources 20B. The fluid sprayed out through the spray sources 20B also impacts in the recesses 34 as described with reference to FIG. 1. The force imparted by the fluid from the spray source 20B also provides momentum to push the vehicle 13 up the upward section 56, as shown in FIG. 3.

In some embodiments, the spray sources 20A, 20B will provide sufficient momentum to push the vehicle 13 up the upward section 56 and onto the declined section 58. In other embodiments, the upward section 56 may contain further sensors and associated spray sources to provide added momentum. In some embodiments, the PLC 38 will control the spray sources to spray for a defined length of time. In some embodiments, the control system 37 will incorporate further sensors that will turn off the sources of water spray when the vehicle 13 is detected by those sensors.

In some embodiments, rather than having the sensors along the uphill portion 56, there may be sensors at the entrance to the section 50. The sensors may activate the spray sources, either simultaneously or sequentially, when the vehicle is detected entering the section 50. In this embodiment, the spray sources may be activated for a specific period of time or there may be additional sensors at the end of the section 50 for turning of the spray sources when a vehicle is detected.

In some embodiments, the sensors may be omitted and the spray sources activated a defined period of time after a vehicle has commenced the ride. It will be appreciated that numerous other control arrangements are possible.

In some embodiments, the spray sources 20A, 20B may be a solid stream nozzle or a spray nozzle. The nozzle may have a diameter in the range of 1 inch to 2 inches. The nozzle may be in the range of 0° to 15°. The flow rate through the nozzles may be in the range of 5 to 50 gallons per minute.

Figure 5A:
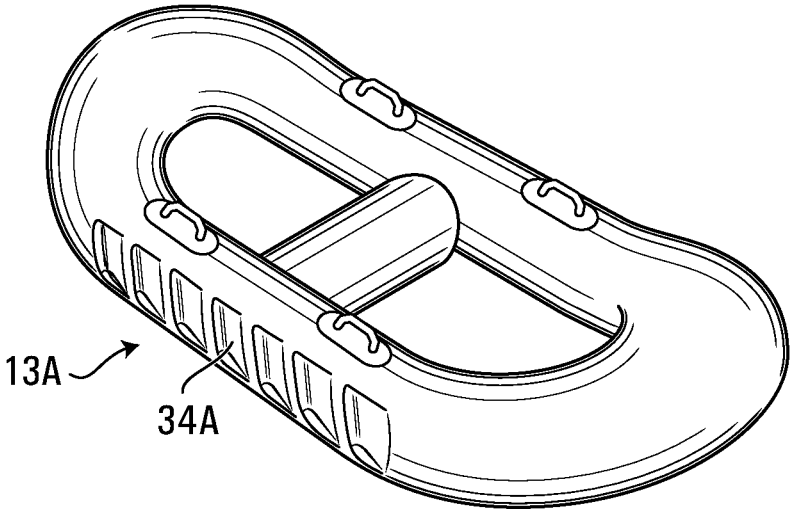
FIGS. 5A, 5B and 5C are perspective views of vehicles which may be used with the system of FIG. 1.
Figure 5B:
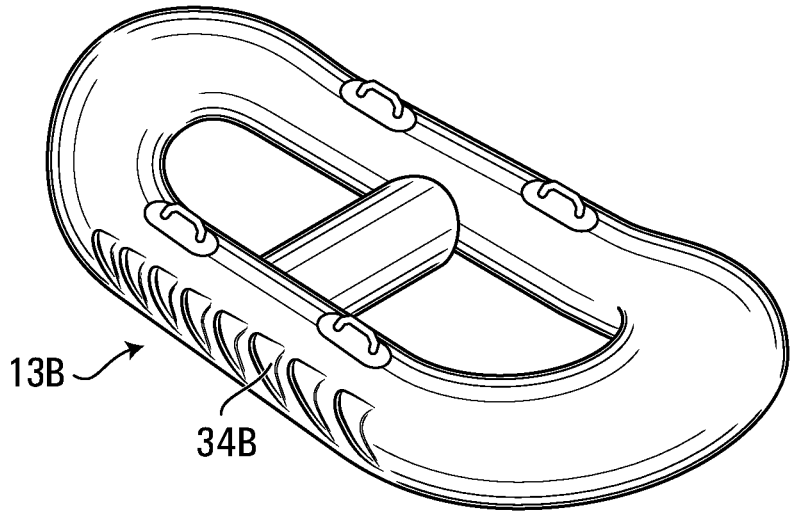
Figure 5C:
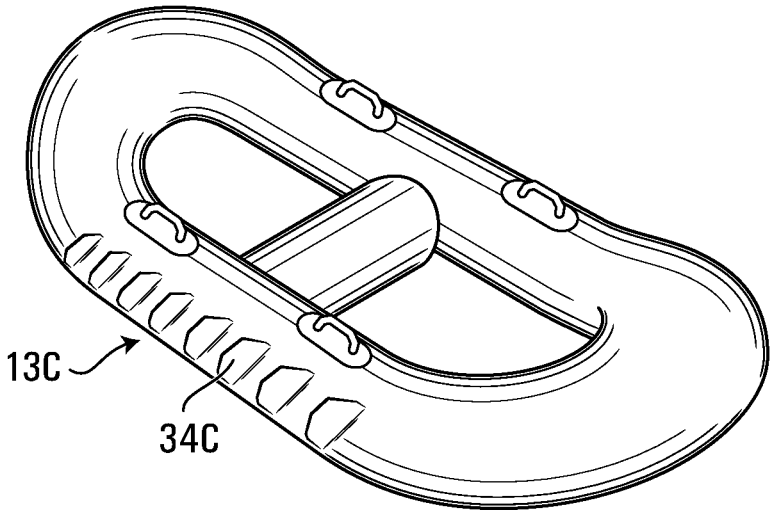
Figure 6A:
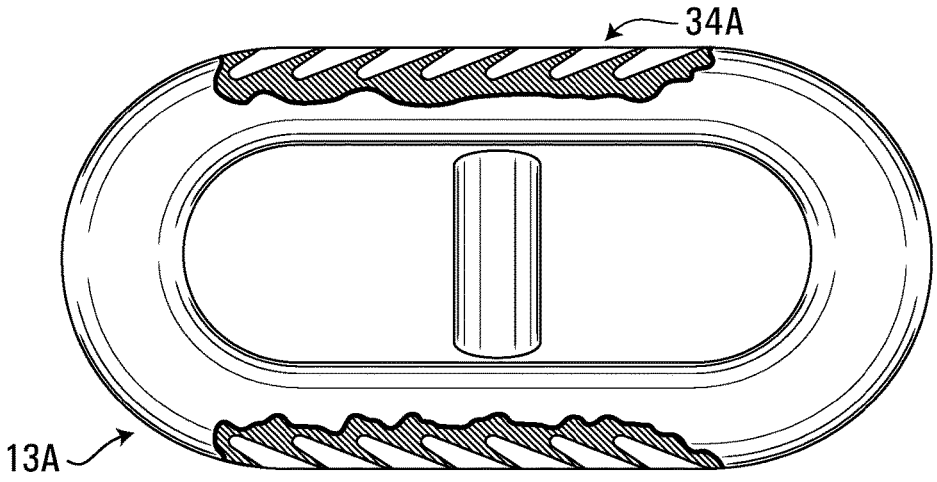
FIGS. 6A, 6B and 6C are cross-sectional view of the vehicles of FIGS. 5A, 5B and 5C.
Figure 6B:
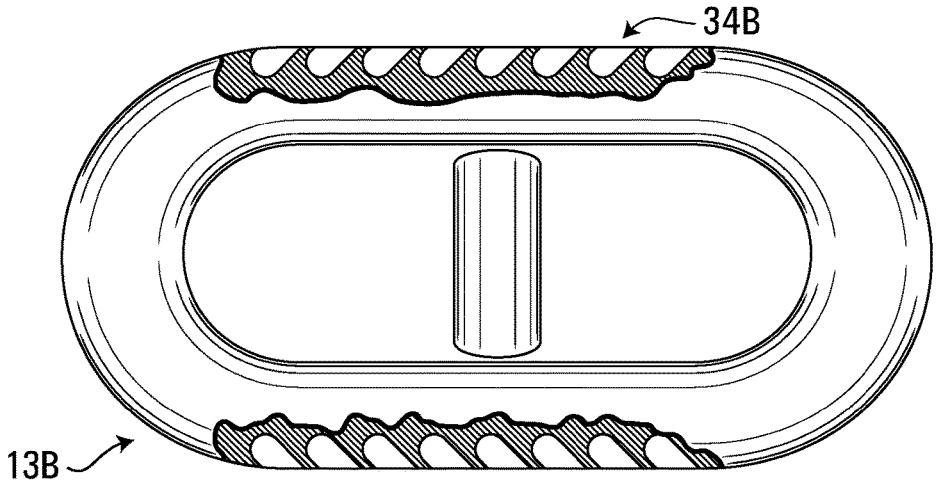
Figure 6C:
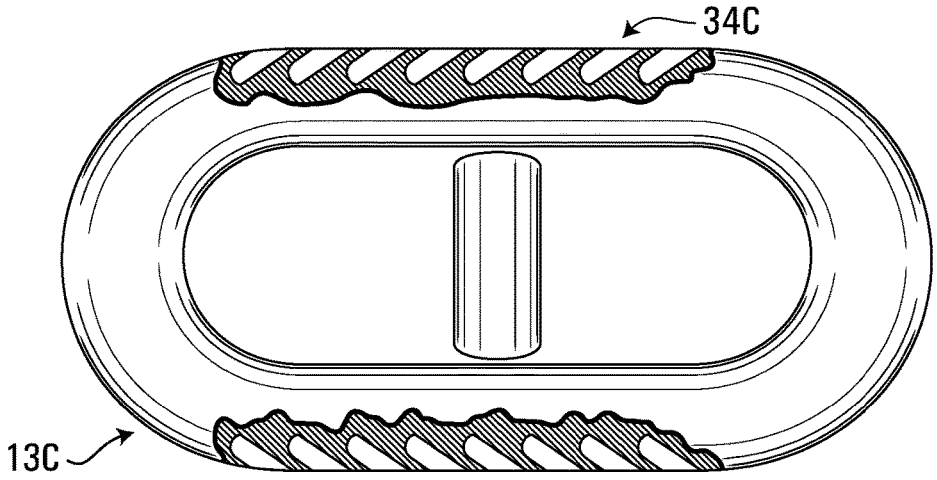

FIGS. 5A, 5B and 5C show perspective views of vehicles 13A, 13B and 13C showing exemplary shapes of the recesses 34A, 34B and 34C to be used with the system of FIG. 1. FIGS. 6A, 6B and 6C show cross sections of these vehicles 13A, 13B and 13C through the recesses 34A, 34B and 34C. It will be appreciated that the shape, angle and number of the recesses may be varied. And provide differing amounts of thrust to the vehicles 13A, 13B and 13C when impacted by fluid from the spray sources. The recesses may be formed, for example, by having the outer sides of the vehicle comprise foam into which the protrusions are moulded or cut. The force applied to the vehicle may be maximized when the fluid impact surfaces are perpendicular to the flow of fluid from the spray sources.

Figure 7A:
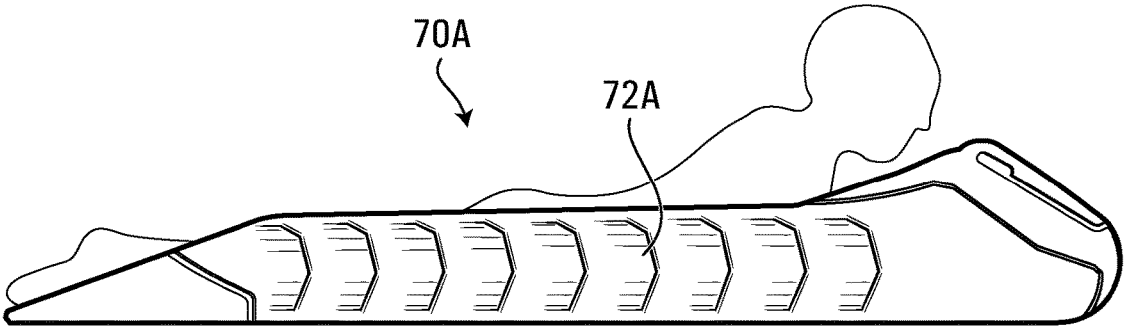
FIGS. 7A, 7B and 7C are side views of other vehicles which may be used with the system of FIG. 1.
Figure 7B:
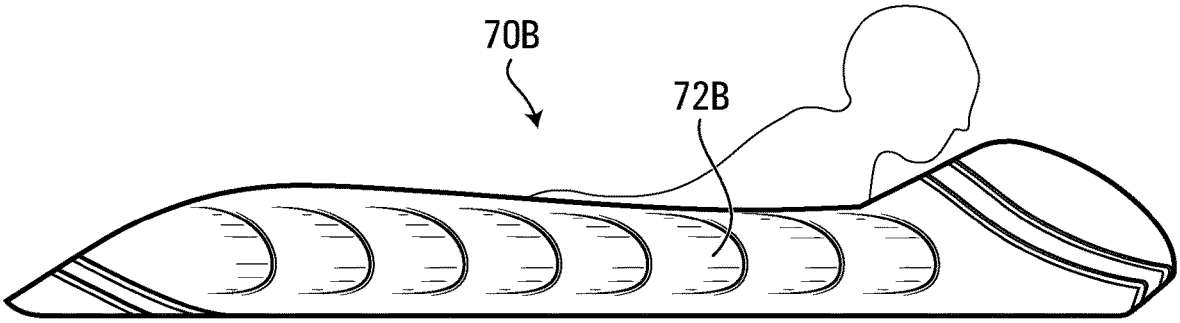
Figure 7C:
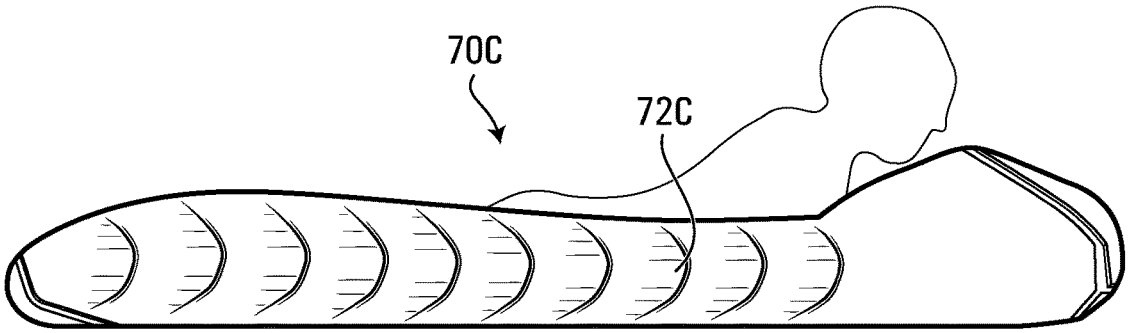

The invention is not limited to raft style vehicles. FIGS. 7A, 7B and 7C depict sled type vehicles 70A, 70B and 70C which may have handles (not show) which a rider may hold while riding on their stomach. As with FIGS. 5A to 6C, FIGS. 7A, 7B and 7C depict various different shapes and numbers of recesses 72A, 72B and 72C which may be used in embodiments of the invention. Numerous other ride vehicle shapes are possible such as circular vehicles, for example, as disclosed in U.S. Design Pat. No. D510,971 and clover shaped vehicles, for example, as disclosed in U.S. Design Pat. No. D464,390, each of which is incorporated herein by reference in its entirety.

Figure 8A:
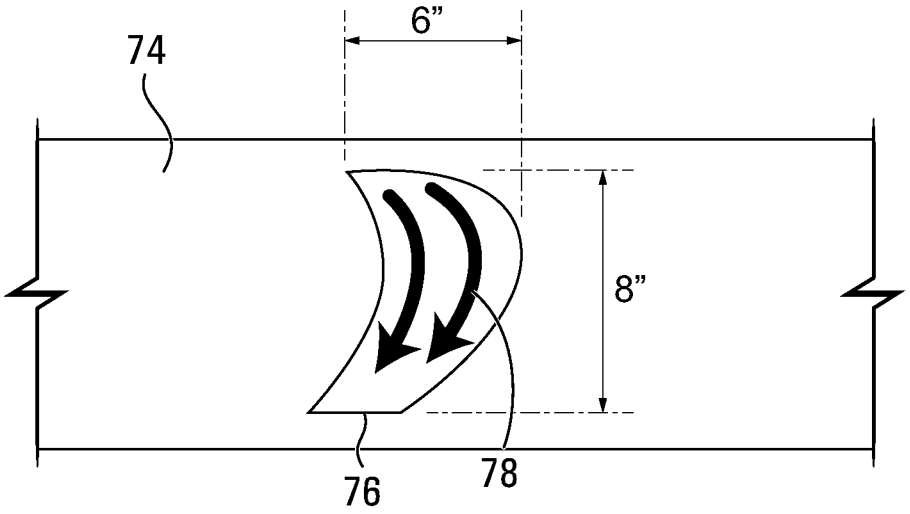
FIGS. 8A and 8B are top and side views, respectively, of a section of a side of a vehicle according to the embodiment of FIG. 1.
Figure 8B:
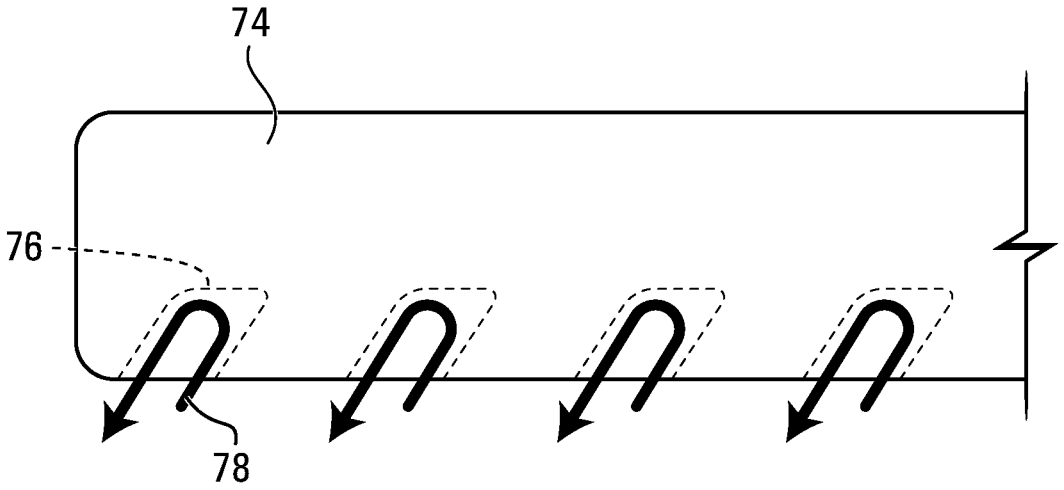

In some embodiments, the recesses may be separate while in other embodiments, the recesses may be connected by a channel. FIGS. 8A and 8B show side and top views of a section of a vehicle side 74. These figures indicate exemplary recess dimensions of 6 inches in width and 8 inches in height, but other dimensions and shapes may be used in other embodiments. The vehicle side 74 has a recess 76 and no internal channel. FIGS. 8A and 8B include arrows 78 which schematically show the flow of fluid which is directed into the recesses 76 from fluid spray sources. It will be appreciated from FIG. 8B that the fluid will follow a curving path into and out of the recesses.

Figure 8C:
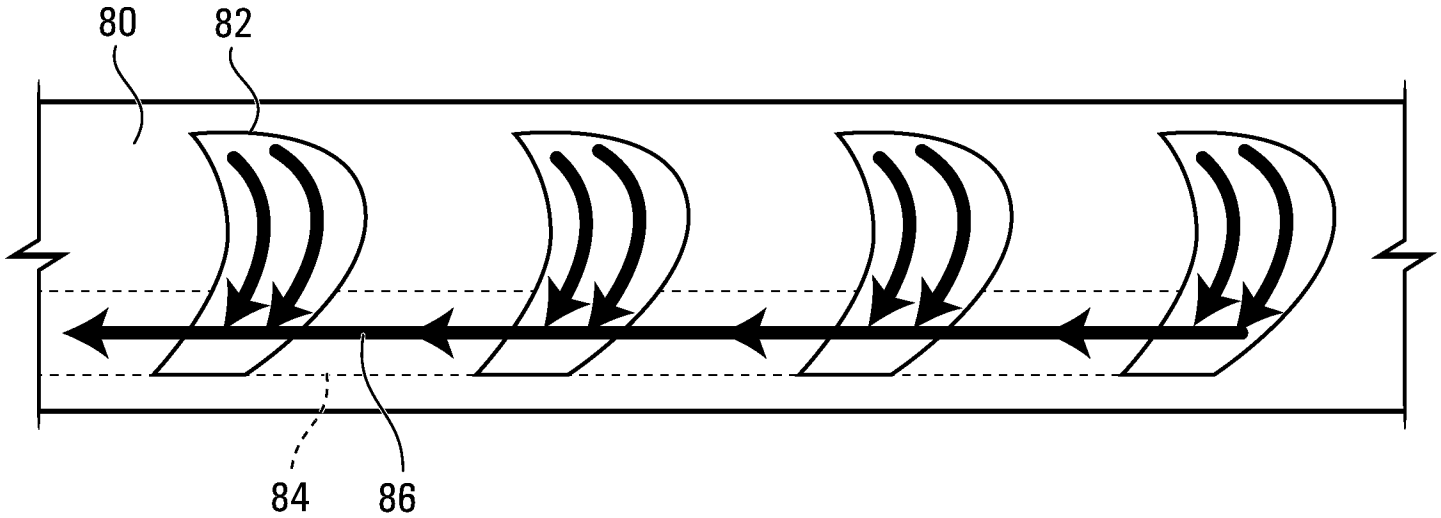
FIGS. 8C to 8E are top and two side views, respectively, of a section of a side of a vehicle according to another embodiment of the invention.
Figure 8D:
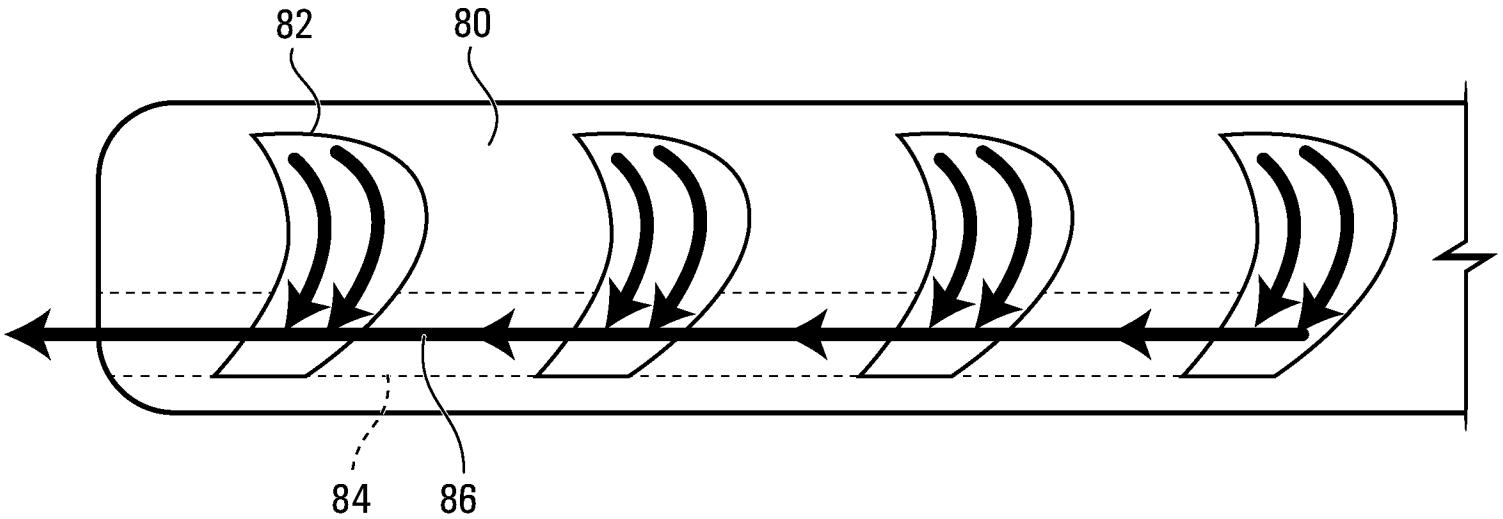
Figure 8E:
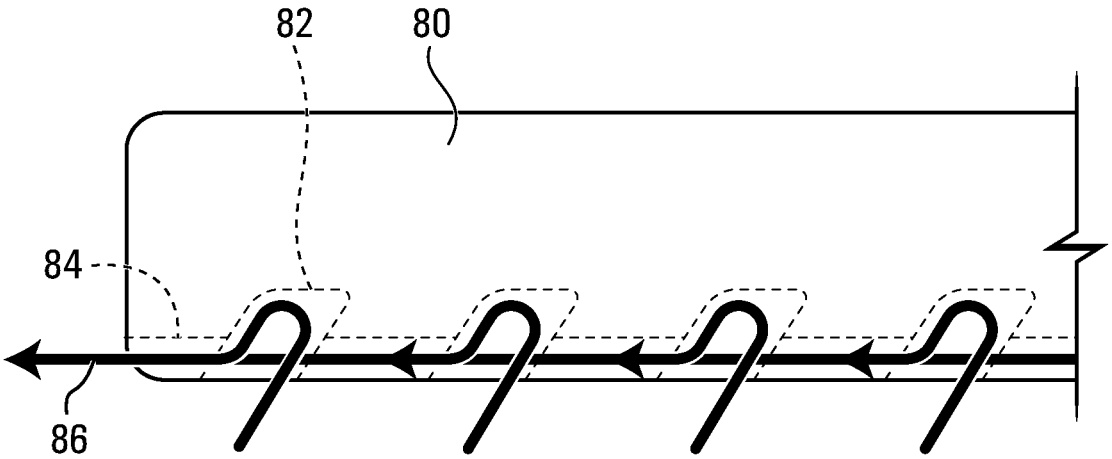

In contrast to FIGS. 8A and 8B, FIGS. 8C to 8E show an embodiment in which the recesses are connected by a channel 84. FIGS. 8C to 8E show side and top views of a section of a vehicle side 80. The vehicle side 80 has recesses 82 and an internal channel 84 which connects the recesses 82. FIGS. 8C to 8E include arrows 86 which schematically show the flow of fluid which is directed into the recesses 82 from fluid spray sources. It will be appreciated from FIGS. 8C to 8E that the fluid sprayed into the recesses 82 will flow down into the channel 84 and then rearwardly out of the vehicle as shown in FIGS. 8D and 8E.

In the embodiment if FIGS. 8C to 8E, each of the recesses 82 is connected to the main channel 84. In some embodiments, there may be a separate channel for each recess. One or more of the separate channels may be interconnected. The channels direct fluid behind, below or through the vehicle. In some embodiments, for example where the system is used to slow the vehicle, the channels may direct the fluid in front of the vehicle. The recesses 82 may have other shapes, such as downward rear openings, to facilitate the evacuation of water from the recesses.

Figure 9:
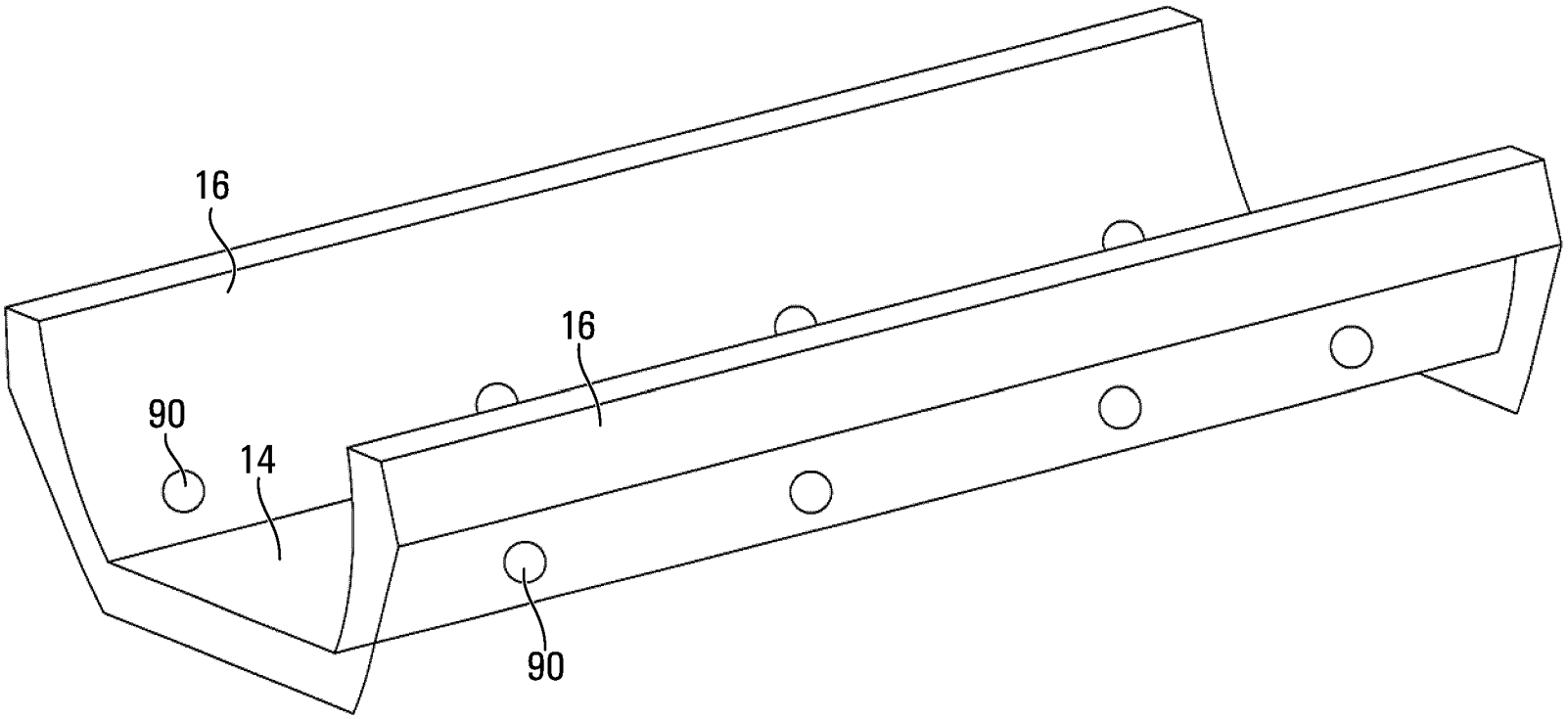
FIG. 9 is a perspective view of a section of an amusement ride channel according to the embodiment of FIG. 1.

FIG. 9 shows a perspective view of a section of the channel 12 of the amusement ride motion control system 10 of FIG. 1. The side walls 16 and the bottom 14 of the channel 12 are shown. Also shown are openings 90. The openings 90 are provided, for example, to allow positioning of the angle at which the water spray sources 20A, 20B (see FIG. 1) spray across the channel 12. The angle may be adjusted both along the channel and towards and away from the channel.

In some embodiments, rather than having recesses or intakes defined in the walls of the vehicle, there are protrusions from the vehicle body. The embodiment of FIGS. 10A to 10E depict top, side, bottom front and rear views, respectively, of the body of such a vehicle 93. The vehicle 93 of this embodiment is a modified raft type vehicle having a vehicle body with a front end 92, a rear end 94, sides 96, and a bottom 98. The vehicle 13 has an inflated tube 100 extending partly around the perimeter of the vehicle 93 and defines the front end 92 and sides 96. The middle of the rear end 94 is open. The bottom 98 connects to the bottom surface of the inflated tube 30 (see FIG. 10E) to define an interior on the vehicle 93 for carrying passengers. In this embodiment, the vehicle 93 also includes two backrests 102 allowing the vehicle 93 to accommodate two riders.

In this embodiment, as noted above, the sides 96 are defined by the inflated tube 100 connected to the bottom 98.

Figure 10A:
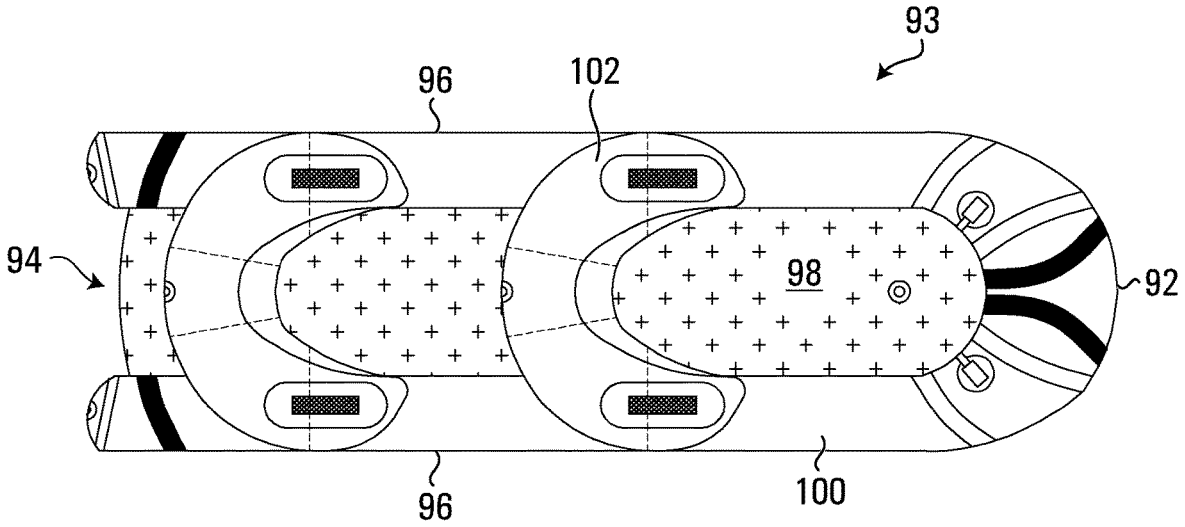
FIGS. 10A to 10E are top, side, bottom, front and rear views, respectively, of a vehicle according to another embodiment of the invention.
Figure 10B:
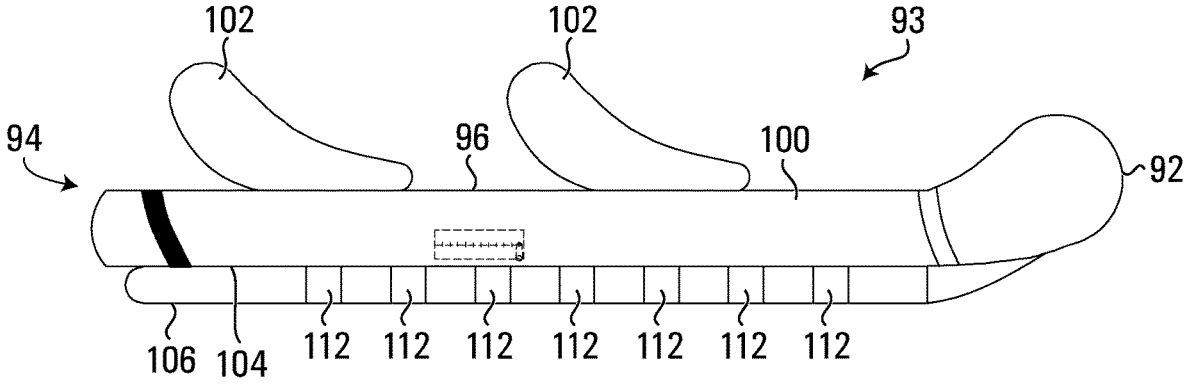
Figure 10C:
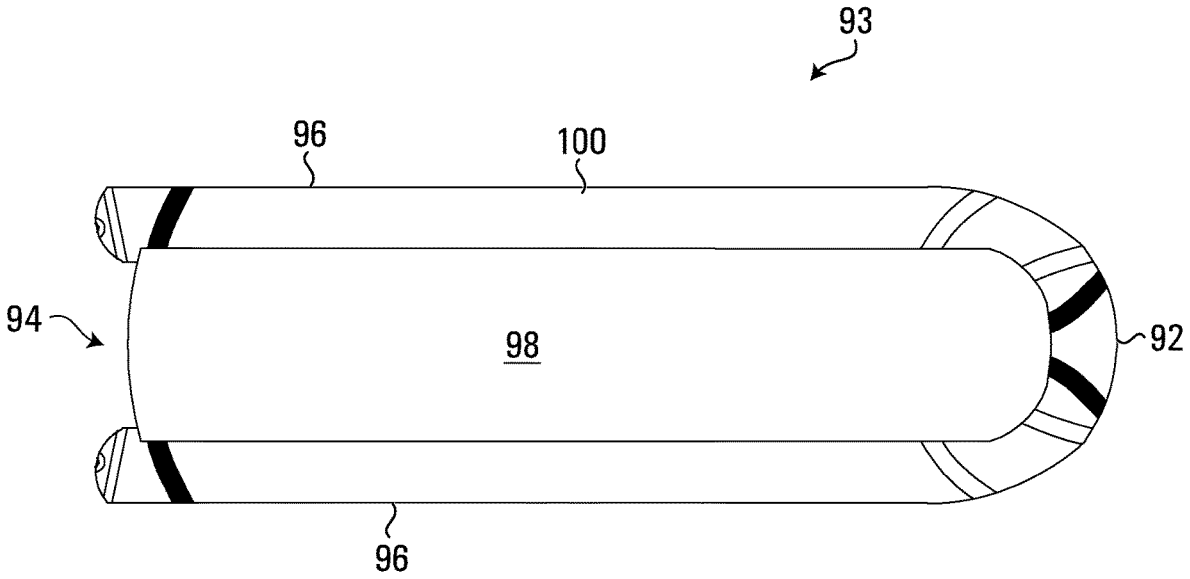
Figure 10D:
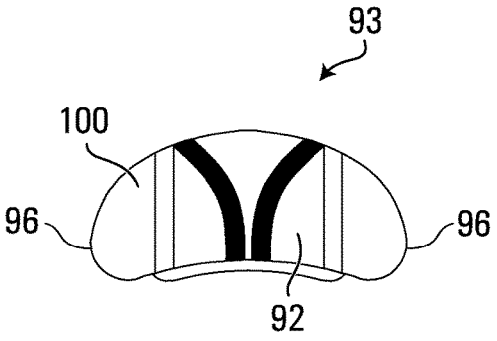
Figure 10E:
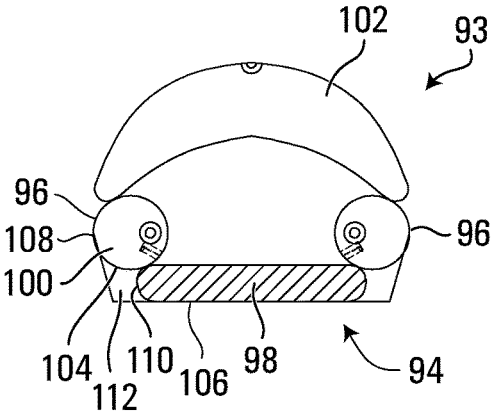
Figure 11A:
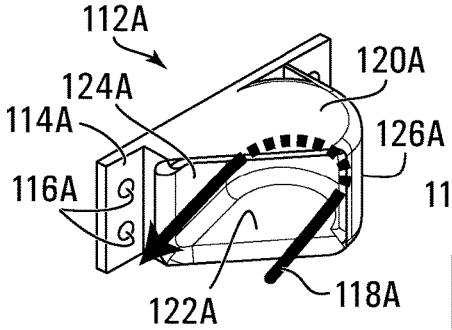
FIGS. 11A to 14C are perspective, top, side and operational views of three protrusion designs for use with the embodiment of FIGS. 10A to 10E.
Figure 11B:
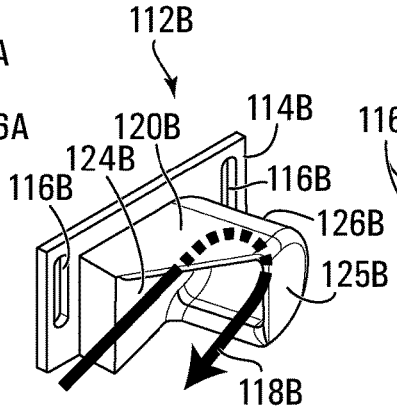
Figure 11C:
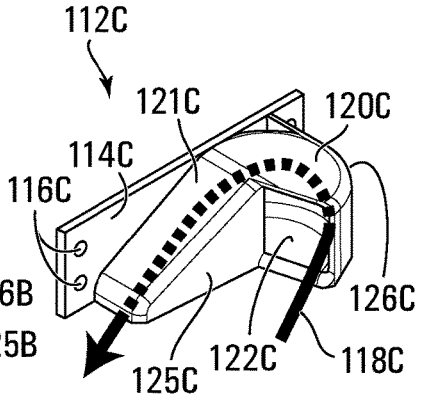
Figure 12A:
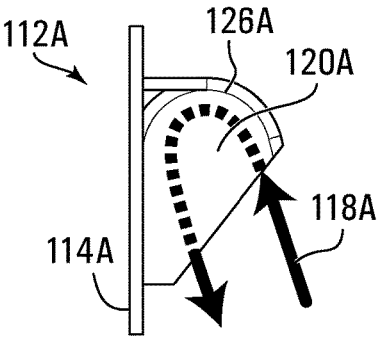
Figure 12B:
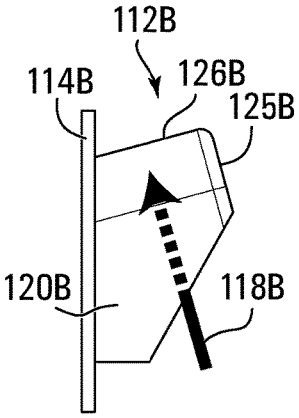
Figure 12C:
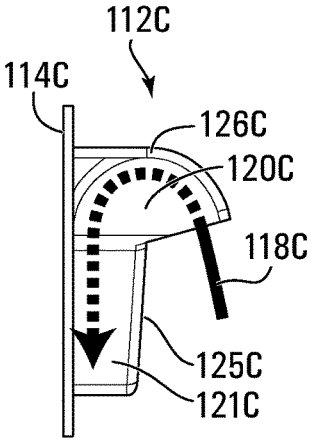
Figure 13A:
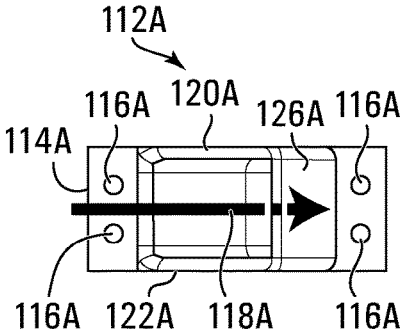
Figure 13B:
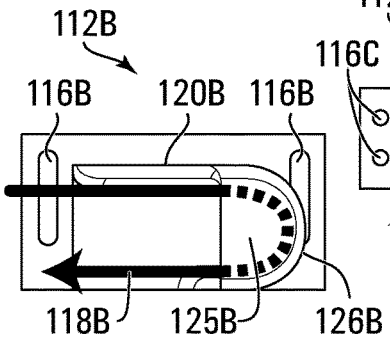
Figure 13C:
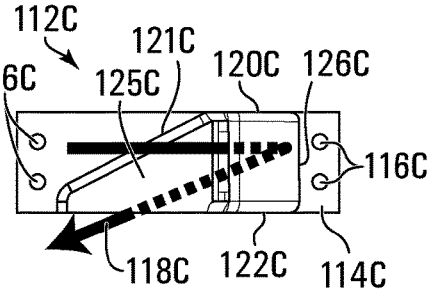

As best seen in FIGS. 10B and 10E, a bottom surface 104 of the tube 100 is above a bottom surface 106 of the bottom 98 of the vehicle 93 and outside surfaces 108 of the sides 96 of the vehicle 93 are outward beyond outside surfaces 110 of the bottom 98. This defines a two sided area in which protrusions 112 may be located. A plurality of the protrusions 112 may be spaced along the opposite sides 96 of the vehicle and angled to provide impact surfaces against which water from spray sources may impact to apply a force to the vehicle 93. In this embodiment, the protrusions 112 are beneath the inflated tube 100 and adjacent the bottom 98 but do not extend outward past the outer sidewalls of the sides 96 or beneath the underside of the bottom surface 104 of the vehicle. The protrusions may be flat, concave, convex or have an irregular impact surface. They may be angled to be perpendicular to the direction of the spray from the spray sources, or at lesser or greater angles. The angles, positioning and shape of the protrusions may differ from each other.

In some embodiments, the protrusions may be integrally formed with the vehicle 93. In other embodiments, the protrusions 112 may be separate components that may be attached to the vehicle 93. In some embodiments, the protrusions may be removable and repositionable, both with respect to their number and their angle. The protrusions may also be beneath the bottom surface of the vehicle 93.

The protrusions may be of different shapes beyond the irregular shape shown in FIGS. 10B and 10E. The protrusions may also extend outward beyond the outer surfaces 108 of the vehicle 93 or above the sides 96 of the vehicle or any combination of such protrusions and the recesses discussed with respect to FIGS. 1 to 8E.

FIGS. 11A to 13C depict three different designs for protrusions 112A, 112B and 112C which may be attached to vehicle 93. The protrusions 112A, 112B and 112C each have respective back plates 114A, 114B and 114C with openings 116A, 116B and 116C defined there through. The openings 116A, 116B and 116C may be used to fasten the protrusions 112A, 112B and 112C to the vehicle using fasteners such as bolts. The protrusions 112A, 112B and 112C may not have back plates 114A, 114B and 114C and openings 116A, 116B and 116C but may instead be fastened by other means such as an adhesive. Multiple protrusions may also be formed on a single back plate, rather than a single protrusion for each back plate.

The protrusion 112A, 112B and 112C have differing shapes intended to direct water impacting against the protrusions 112A, 112B and 112C in different directions. Arrows 118A, 118B and 118C indicate how the water is directed by each of the protrusions 112A, 112B and 112C. Mirror images of protrusions 112A, 112B and 112C may be provided for the opposite side of the vehicle 93.

The protrusion 112A has a flat parallel spaced apart top 120A and bottom 122A. An inner wall 124A extends beside the back plate 114A and connects the top 120A and the bottom 122A. The inner wall 124A is at an angle of approximately 15° to back plate 114A. An end wall 126A has a vertically oriented tubular shape extending between the top 120A and the bottom 122A. The top 120A, the bottom 122A, the inner wall 124A and the end wall 126A together define a water intake or cavity with an outwardly angled rectangular opening. A water jet sprayed into the cavity of the protrusion 112A follows the path defined by arrow 118A. In particular, the water travels a U-shaped horizontal path. The end wall 126A functions as an impact surface. The water travels horizontally in and impacts against the end wall 126A and is deflected to follow in a semicircle around the curvature of the end wall 126A. The water exits horizontally along the inner wall 124A in a path offset parallel to the path of the water when entering the protrusion 112A.

The protrusion 112B has a flat top 120B with an open bottom and parallel inner and outer walls 124B, 125B. The inner wall 124B extends beside the back plate 114B and connects to the top 120B. The inner wall 124B is at an angle of approximately 15° to back plate 114B. An end wall 126B has a horizontally oriented tubular shape extending between the inner wall 124B and the outer wall 125B. The top 120B, the inner wall 124B, the outer wall 125B and the end wall 126B together define a water intake cavity with an outwardly angled rectangular opening and an open bottom. A water jet sprayed into the cavity of the protrusion 112B follows the path defined by arrow 118B. In particular, the water travels a U-shaped path. The end wall 126B functions as an impact surface. The water travels horizontally in, impacts against the end wall 126B and is deflected vertically downward along a U-shaped path to follow in a semicircle along the curvature of the end wall 126B. The water exits along a path offset vertically below and parallel to the path of the water when entering the protrusion 112B.

The protrusion 112C has a wedge shaped part and an end part. The end part has a flat parallel spaced apart top 120C and bottom 122C. An end wall 126C has a vertically oriented tubular shape extending between the top 120C and the bottom 122C. An inner side of the end wall 126C connects to the back plate 114C. Together the top 120C, the bottom 122C, and the end wall 126C define a portion of a water intake cavity.

The wedge shaped part extends beside the back plate 114C and has a triangular shaped outer wall 125C parallel to the back plate 114C and a downwardly angled top plate 121C interconnecting the back plate 114C and the outer wall 125C. The wedge shaped part has an open bottom and defines a second portion of a water intake cavity. A rectangular end of the wedge shaped part connects to an inner half of the end part to define a vertical rectangular inlet opening to the intake cavity and a rectangular horizontal outlet opening from the intake cavity. A water jet sprayed into the cavity of the protrusion 112C follows the path defined by arrow 118C. The end wall 126C functions as an impact surface. The water travels horizontally in and impacts against the end wall 126C and is deflected to follow in a semicircle around the curvature of the end wall 126C. The water is then directed to angle downward by the wedge shape part and exits angled downwardly in along the back plate 114C.

Figure 14A:
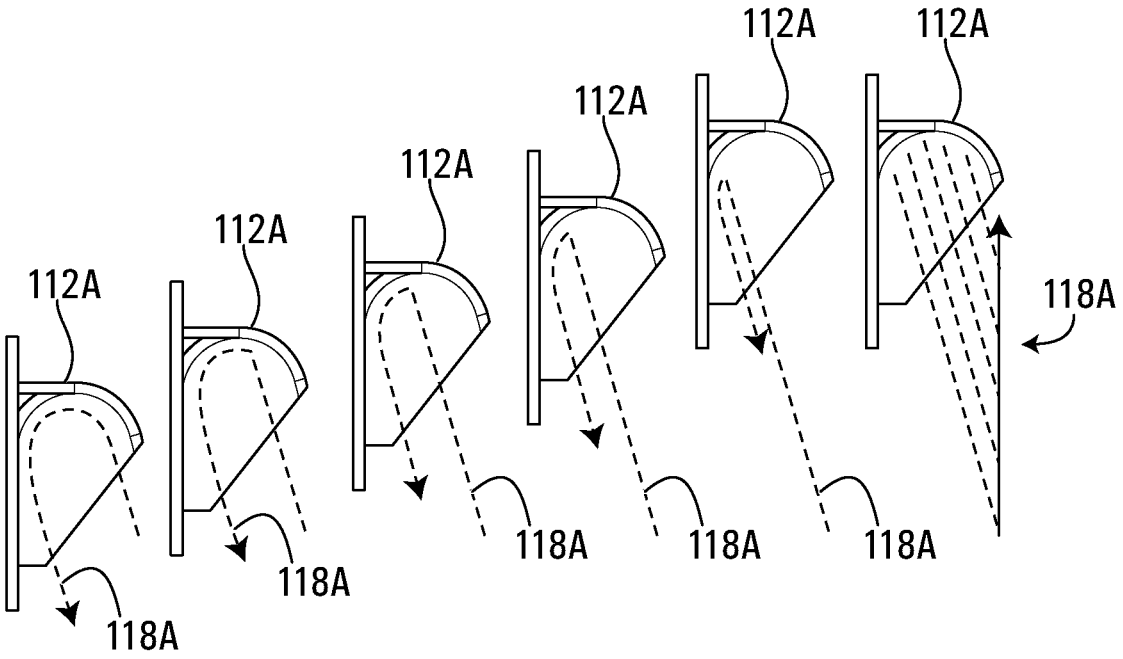
Figure 14B:
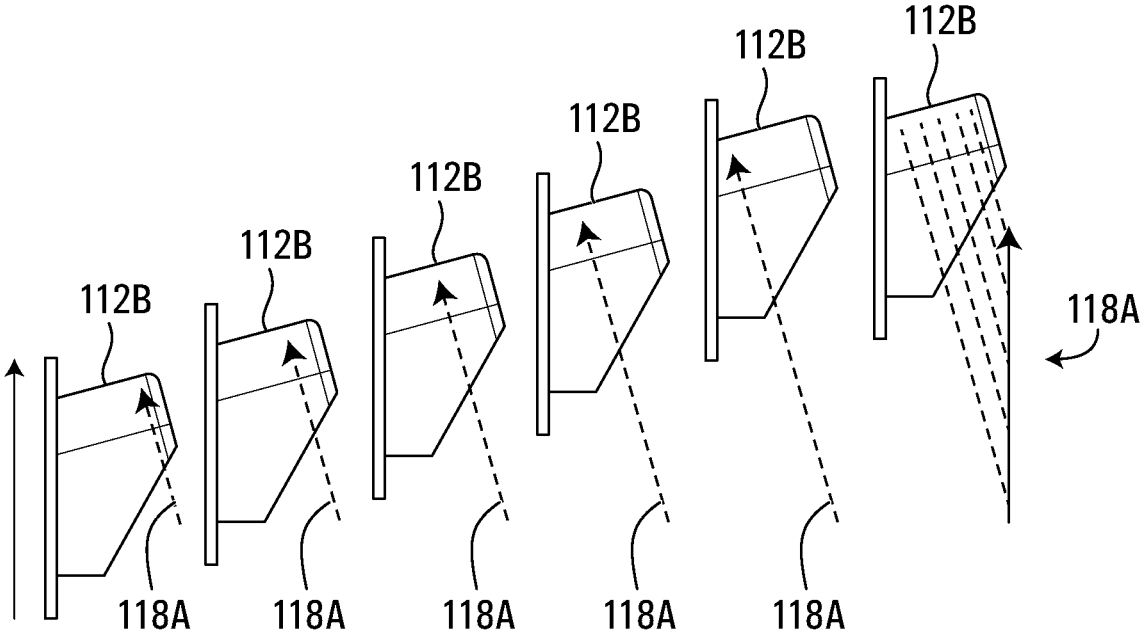
Figure 14C:
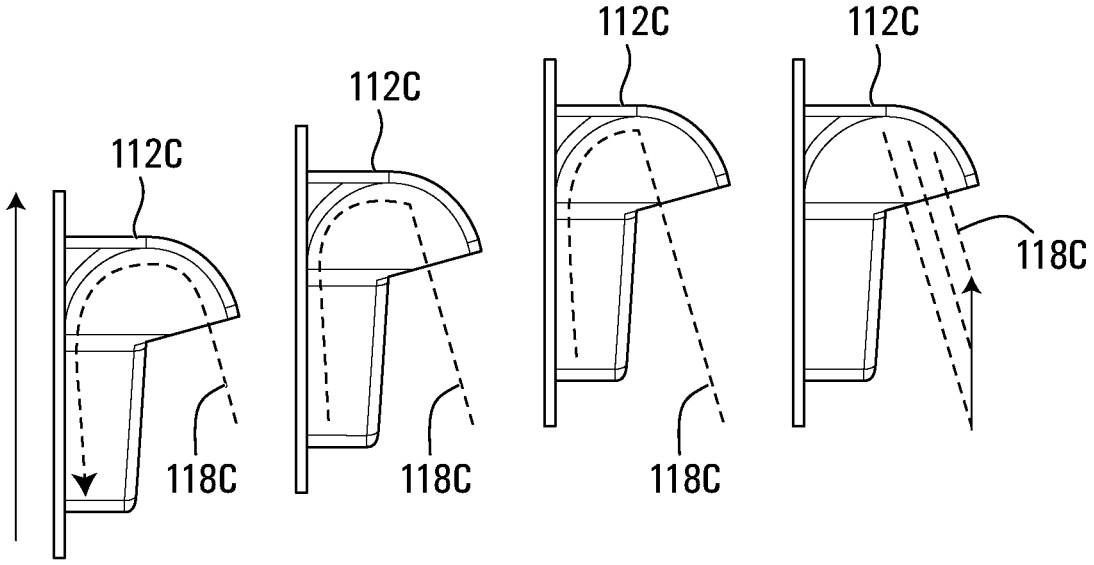

The impact of the water jet against the impact surfaces of the protrusions 112A, 112B and 112C applies a force to the vehicle 93 to propel the vehicle forward. FIGS. 14A, 14B and 14C illustrate how the path of a water jet 118A, 118B and 118C changes as the vehicle 93 moves forward away from the source of the water jet 118A, 118B and 118C.

The protrusions 112A, 112B and 112C are exemplary protrusions. In this embodiment, the protrusions 112A and 112B have height×length×width dimensions of 2.5"×6"×3" and the protrusions 112C have height×length×width dimensions of 2.5"×8"×4" for a 4" intake. It will be appreciated that numerous other shapes and dimensions of protrusions and recesses, with or without an intake cavity, can be formed which define an impact surface to receive a force applied by a jet of water to cause movement of the vehicle 93. The protrusions and recesses can be sized positioned and provided in such numbers as required to impart, in combination with the jet spray, the desired force to the vehicle.

In some embodiments the recesses and protrusions and the spray sources may be oppositely oriented, such that the forces applied by the spray sources on the vehicle will act against the direction of travel of the vehicle, for example to decelerate the vehicle. In other embodiments, for example, a circular vehicle with recesses around the perimeter in the same orientation, the spray sources may be on only one side. The forces applied by the spray sources on the vehicle may cause the vehicle to rotate. In some embodiments, the recesses and protrusions may be asymmetrical to cause uneven force to be applied to different areas of the vehicle, such as along the sides or on opposite sides.

Figure 15:
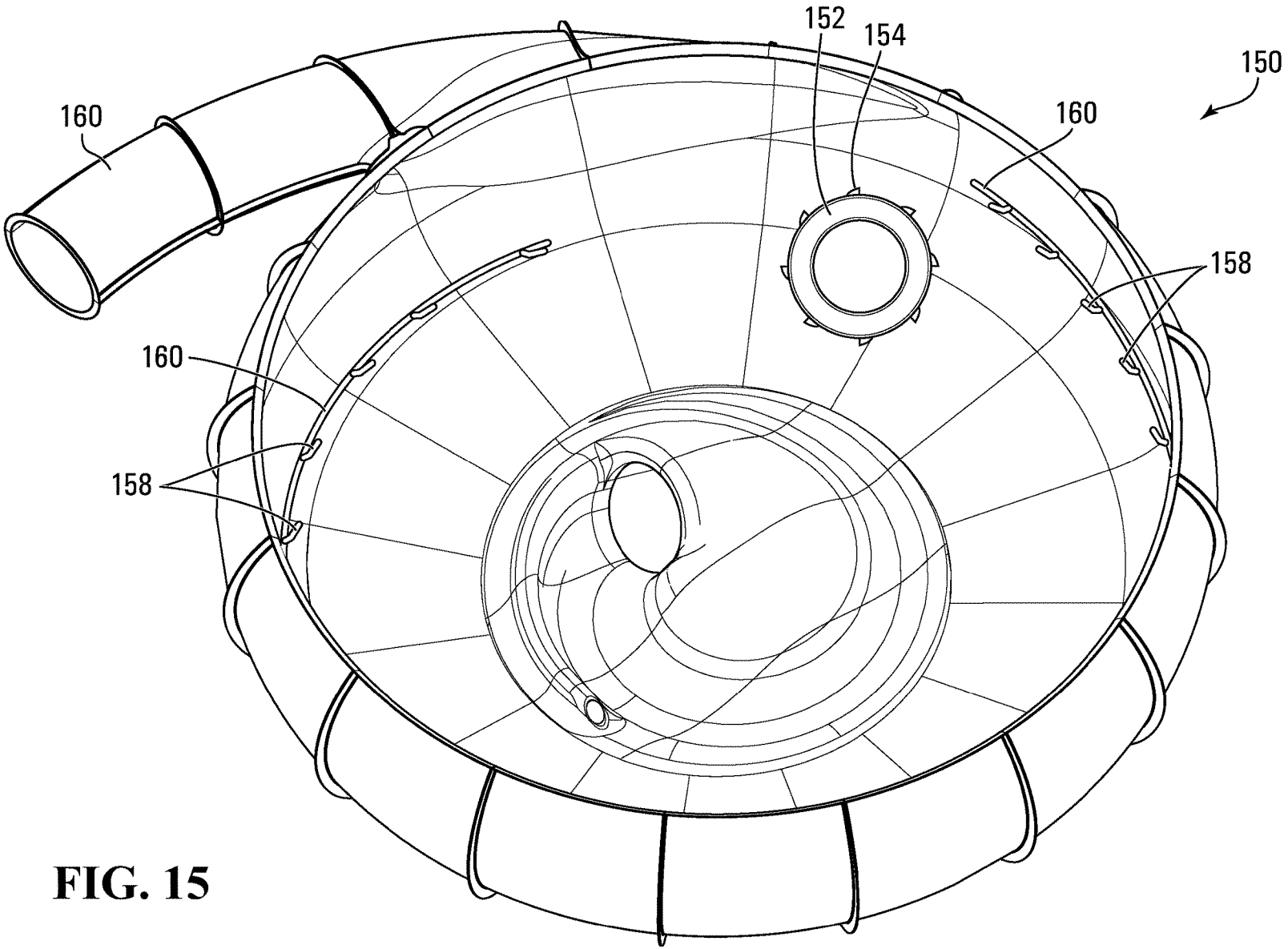
FIG. 15 is a schematic view of a waterslide according to another embodiment of the invention.

In other embodiments, the invention is used in association with other types of amusement rides such as a funnel ride as described in U.S. Pat. No. 6,857,964 and bowl-style rides as shown in U.S. Design Pat. No. D521,098, each of which are incorporated herein by reference in its entirety. FIG. 15 illustrates a circular vehicle 152 sliding on such a bowl-style ride feature 150. Vehicle 152 has a plurality of water intake protrusions 154 around its perimeter. A plurality of water jet spray sources 158 are connected through a water inlet pipe 156 which may be mounted on the surface of or below the surface of the ride feature 150 with the water jet spray sources 158 protruding through the surface of the ride feature 150. The ride feature 150 has an inlet 160 through which the circular vehicle 152 enters the ride feature 150. It will be appreciated that water jets sprayed from the spray sources 158 can impact against the water intake protrusions 154 and impart a spinning force or, depending on the relative orientation of the water jets and the protrusions and/or recesses, another force to slow down, speed up or otherwise affect movement of the vehicle 152.

In some embodiments, the fluid impact surfaces are beneath the surface of the water in the channel and the jets pump a stream of water through the water in the channel to impact against the fluid impact surfaces.

Numerous modifications and variations of the present invention are possible in light of the above teachings. It is therefore to be understood that within the scope of the appended claims, the invention may be practised otherwise than as specifically described herein.

The invention claimed is:

1. An amusement ride vehicle comprising: a body and at least one of recesses and protrusions on a perimeter surface of the body, the at least one of recesses and protrusions defining fluid impact surfaces, the fluid impact surfaces being at an angle to an intended direction of motion of the vehicle to affect motion of the vehicle when the fluid impact surfaces are impacted by a fluid;

wherein the at least one of recesses and protrusions comprise a plurality of recesses or a plurality of protrusions spaced along opposite sides of the vehicle body.

2. The amusement ride vehicle of claim 1 wherein at least a portion of an underside of the body is adapted to slide on a sliding surface.

3. The amusement ride vehicle of claim 1 wherein the vehicle is adapted to float in a fluid.

4. The amusement ride vehicle of claim 1 wherein the fluid is water.

5. The amusement ride vehicle of claim 1 wherein the vehicle comprises outer sidewalls and a bottom surface and the plurality of recesses or the plurality of protrusions do not extend outward past the outer sidewalls or beneath the bottom surface of the vehicle body or above the top surface of the vehicle.

6. The amusement ride vehicle of claim 5 wherein vehicle comprises sides and a bottom and the plurality of recesses or the plurality of protrusions are located beneath the sides and adjacent the bottom of the body.

7. The amusement ride vehicle of claim 1 wherein the vehicle body has a forward end and a rearward end, wherein the at least one of recesses and protrusions have an inward end and a rear outward end, and wherein the inward end of the at least one of recesses and protrusions is closer than the rear outward end of the at least one of recesses and protrusions to the forward end of the vehicle body such that the at least one of recesses and protrusions are angled forward.

8. The amusement ride vehicle of claim 7 wherein the fluid impact surfaces face the rear end on the vehicle body and are concave.

9. The amusement ride vehicle of claim 1 wherein the at least one of recesses and protrusions are removable and repositionable.

10. The amusement ride vehicle of claim 1 further comprising at least one channel, wherein the at least one of recesses and protrusions are connected to the at least one channel for directing water away from the fluid impact surface after impact.

11. The amusement ride vehicle of claim 10 wherein the at least one channel comprises a plurality of channels and each of the at least one of recesses and protrusions are connected to respective channels of the plurality of channels.

12. The amusement ride vehicle of claim 11 wherein at least some of the plurality of channels are interconnected.

13. The amusement ride vehicle of claim 10 wherein the at least one channel directs fluid behind, below or through the vehicle.

14. An amusement ride vehicle motion control system comprising:

an amusement ride vehicle of claim 1;

a channel; and at least one fluid spray source positioned to spray fluid over the channel at the fluid impact surfaces.

15. An amusement ride vehicle motion control system comprising:

a channel;

a plurality of fluid spray sources positioned to spray fluid over the channel;

an amusement ride vehicle comprising: a body and at least one of recesses and protrusions on a perimeter surface of the body, the at least one of recesses and protrusions defining fluid impact surfaces, the fluid impact surfaces being at an angle to an intended direction of motion of the vehicle, the fluid impact surfaces being adapted to affect motion of the vehicle when the fluid impact surfaces are impacted by a flow of fluid from the plurality of fluid spray sources;

wherein the at least one of recesses and protrusions comprise a plurality of recesses or a plurality of protrusions spaced along opposite sides of the vehicle body.

16. The amusement ride vehicle motion control system of claim 15 further comprising a first sensor adapted detect when the amusement ride vehicle enters a zone of a sliding surface; at least one valve associated with the plurality of fluid spray sources; and a controller adapted to open the valve to turn on the fluid spray source in response to the amusement ride vehicle entering the zone.

17. The amusement ride vehicle motion control system of claim 16 further comprising a second sensor adapted to detect when the amusement ride vehicle leaves a zone of the channel, the controller being adapted to close the valve to turn off the water spray source in response to the amusement ride vehicle exiting the zone.

18. The amusement ride vehicle motion control system of claim 16 wherein the controller is a programmable logic controller.

19. The amusement ride vehicle motion control system of claim 16, further comprising a pump connected to the programmable logic controller by a variable frequency drive, wherein the variable frequency drive is adapted to maintain the pump in a standby mode when the valve is closed, and wherein the variable frequency drive is adapted to actuate the pump when the valve is open.

* * * * *